US011613800B2

(12) United States Patent
Montes et al.

(10) Patent No.: US 11,613,800 B2
(45) Date of Patent: Mar. 28, 2023

(54) CLEAN ALUMINUM ALLOYS AND METHODS FOR FORMING SUCH ALLOYS

(71) Applicant: Johnson Brass & Machine Foundry, Inc., Saukville, WI (US)

(72) Inventors: Arvin Montes, Kohler, WI (US); Lance Johnson, Saukville, WI (US)

(73) Assignee: Johnson Brass & Machine Foundry, Inc., Saukville, WI (US)

( * ) Notice: Subject to any disclaimer, the term of this patent is extended or adjusted under 35 U.S.C. 154(b) by 319 days.

(21) Appl. No.: 16/796,387

(22) Filed: Feb. 20, 2020

(65) Prior Publication Data

US 2020/0190649 A1 Jun. 18, 2020

Related U.S. Application Data

(60) Division of application No. 16/391,940, filed on Apr. 23, 2019, which is a continuation-in-part of application No. 16/103,404, filed on Aug. 14, 2018, now Pat. No. 11,149,333.

(51) Int. Cl.

| | |
|---|---|
| ***C22F 1/047*** | (2006.01) |
| ***C22C 21/08*** | (2006.01) |
| ***C25D 11/04*** | (2006.01) |
| ***C22F 1/00*** | (2006.01) |
| ***B22D 13/04*** | (2006.01) |

(52) U.S. Cl.

CPC ..... *C22F 1/047* (2013.01); *B22D 13/04* (2013.01); *C22C 21/08* (2013.01); *C22F 1/002* (2013.01); *C25D 11/04* (2013.01)

(58) Field of Classification Search

CPC ..... C22F 1/047; C22F 1/002; B22D 13/04; C22C 21/08; C25D 11/04

See application file for complete search history.

(56) References Cited

U.S. PATENT DOCUMENTS 3,496,624 A 2/1970 Kerr et al.
3,666,638 A * 5/1972 Harris ..... C25D 11/12 205/325
3,791,876 A 2/1974 Kroger
4,055,417 A 10/1977 Komiyama et al.

(Continued)

FOREIGN PATENT DOCUMENTS

JP H06-248401 A 9/1994
JP 2012224929 A * 11/2012 ..... B21B 1/22

OTHER PUBLICATIONS

JP2012224929A description english translation (Year: 2012).*

(Continued)

*Primary Examiner* — Anthony J Zimmer
*Assistant Examiner* — Ricardo D Morales
(74) *Attorney, Agent, or Firm* — Foley & Lardner LLP

(57) ABSTRACT

A method comprises providing a molten aluminum alloy selected from the group consisting of 6000 series aluminum alloys comprises chromium (Cr) in a range of between 0.001 wt % to 0.05 wt %. The molten aluminum alloy is formed into a formed body having beta-AlFeSi particles. The formed body is solution heat treated at a temperature in a range of 1,025-1,050° F. to form a heat-treated body. The solution heat treating transforms substantially all of the beta-AlFeSi particles into alpha-AlFeSi particles such that the heat-treated body is substantially free of the beta-AlFeSi particles.

10 Claims, 19 Drawing Sheets

(56) References Cited

U.S. PATENT DOCUMENTS

| | | | |
|---|---|---|---|
| 4,693,747 | A | 9/1987 | Bretz et al. |
| 4,715,893 | A | 12/1987 | Skinner et al. |
| 5,032,359 | A | 7/1991 | Pickens et al. |
| 5,303,682 | A | 4/1994 | Donahue et al. |
| 5,498,393 | A | 3/1996 | Horimura et al. |
| 5,520,754 | A | 5/1996 | Yaney et al. |
| 5,527,403 | A | 6/1996 | Schirra et al. |
| 5,571,347 | A | 11/1996 | Bergsma |
| 5,595,615 | A | 1/1997 | Shibata et al. |
| 5,603,783 | A | 2/1997 | Ferreira |
| 5,744,734 | A | 4/1998 | Yang et al. |
| 5,837,070 | A | 11/1998 | Sainfort et al. |
| 5,846,348 | A | 12/1998 | Sakoda et al. |
| 5,911,843 | A | 6/1999 | Bergsma |
| 6,120,625 | A | 9/2000 | Zhou et al. |
| 6,146,477 | A | 11/2000 | Clark et al. |
| 6,248,189 | B1 | 6/2001 | Shaffer et al. |
| 6,350,329 | B1 | 2/2002 | Troeger et al. |
| 6,565,984 | B1 | 5/2003 | Wu et al. |
| 6,713,188 | B2 | 3/2004 | Wu et al. |
| 6,846,369 | B1 | 1/2005 | Clark et al. |
| 2001/0023719 | A1 | 9/2001 | Troeger et al. |
| 2005/0150771 | A1 | 7/2005 | Kock et al. |

OTHER PUBLICATIONS

JP2012224929A claims english translation (Year: 2012).*
Samaras et al. ("Modelling of microsegregation and homogenization of 6061 extrudable Al-alloy." Journal of Materials Processing Technology 194.1-3 (2007): 63-73) (Year: 2007).*
Kulunk et al. ("Applications for the strontium treatment of wrought and die-cast Al."JOM, 48(10), (1996, 60-63). (Year: 1996).*
"Aluminum and Aluminum Alloys", ASM International, 1993, p. 72, 73.
"ASM Handbook: vol. 9 Metallography and Microstructures", ASM International, (1985), pp. 357-388.
"Metals Handbook: Desk Edition", 2nd ed., ASM International, 1998, p. 464.
ALCOA TMD Report No. 5, (available at least by Aug. 3, 1999).
American Foundrymen's Society, "Copper-Base Alloys Foundry Practice", pp. 68-72, (1965).
ASM Handbook, vol. 2 Properties and Selection: Nonferrous Alloys and Special-Purpose Materials, p. 141, 1992.
Barre, "Hot Isostatic Processing—A Solution into the 21st Century", (available at least by Aug. 3, 1999).
Barre, International News Magazine of the Investment Casting Institute, pp. 14-15, (Aug. 1998).
Brick, Robert M. et al., Structure and Properties of Engineering Materials, 1977, title p. and pp. 87-91, Fourth Edition, McGraw-Hill Publishing Company, New York.
Chu, H.P. et al., Fracture Toughness and Stress Corrosion Properties of Aluminum Alloy Hand Forgings, Journal of Materials, Mar. 1972, pp. 95-99, vol. 7, #1.
Copper Development Association, "Copper Casting Alloys", p. 96, (1994).
Dieter, George E., Mechanical Metallurgy, 1986, cover, title p. and pp. 526-529, Third Edition, McGraw-Hill Publishing Company, New York.
Janco, "Centrifugal Casting", pp. 1-6, (1988).
Johnson Brass and Machine Foundry, Inc. web site, (www.johnsoncentrifugal.com) materials, (Aug. 6, 1999).
Kittyhawk Products web site (www.kittyhawkinc.com) materials, (available at least by Aug. 6, 1999).
Kittyhawk Products, Hot Isostatic Processing information, (available at least by Aug. 3, 1999).
Macmaster, F.J. et al., Aluminum alloy 6069 part II; fracture toughness of 6061-T6 and 6069-T6, Materials Science and Engineering, 2000, pp. 54-59, A289, Elsevier Science S.A.
PTI, Hot Isostatic Pressing information, (available at least by Aug. 3, 1999).
The Aluminum Association, Inc., "Aluminum standards and data", pp. 4-15, (1979).
Yahr, G.T., Prevention of Nonductile Fracture in 6061-T6 Aluminum Nuclear Pressure Vessels, Journal of Pressure Vessel Technology, May 1997, pp. 150-156, vol. 119.
Kulunk et al., "Applications for the Strontium Treatment of Wrought and Die-Cast Al", JOM 48(10), Oct. 1996, pp. 60-63.
Samaras et al., "Modelling of Microsegregation and Homogenization of 6061 Extrudable Alloy", Journal of Materials Processing Technology 194, Mar. 2007, pp. 63-73.
English language machine translation of JPH06248401A, provided by Examiner in Non-Final Office Action dated Mar. 16, 2022 for U.S. Appl. No. 16/391,940, 6 pages.
Mackenzie, D. Scott, "Heat treatment of aluminum, part II: Water quenching," Thermal Processing, Oct. 2020, 2 pages.

* cited by examiner

HEAT TREAT CYCLE FOR HOMOGENIZATION/SOLUTION TREATMENT OF HT185103

CLEAN ALUMINUM ALLOYS AND METHODS FOR FORMING SUCH ALLOYS

CROSS-REFERENCE TO RELATED APPLICATIONS

The present application is a divisional of U.S. application Ser. No. 16/391,940, filed Apr. 23, 2019, which is a continuation-in-part of U.S. patent application Ser. No. 16/103,404, filed Aug. 14, 2018, the disclosures of each are incorporated herein by reference in their entireties.

TECHNICAL FIELD

The present disclosure relates generally to the field of aluminum alloys.

BACKGROUND

Alloys can be formed by various techniques. For example, an alloy body may be formed via static casting. Static casting includes pouring a molten alloy in a mold and solidifying. However, one potential problem with static casting is that the resulting alloy body can be subject to impurities (dross, oxides, non-metallic inclusions) and high porosity, both of which may reduce the strength of the alloy body. Alloy bodies can also be formed by a wrought method. Such wrought methods include heating an alloy to a temperature below its melting temperature, and plastically deforming the alloy to refine the grain size and reduce porosity. The resulting wrought alloy body has generally less porosity than an alloy body produced by static casting. However, the wrought method is often limited to the use of a small number of "standard" alloys, in addition to generally creating simpler shapes and being more expensive than casting methods.

Centrifugal forming (also known as centrifugal casting) is another method which may be used for making alloys. A centrifugally formed alloy body can have less impurities and porosity than an alloy body produced by static casting. Aluminum pieces produced by centrifugal forming, however may still have a significant amount of porosity and may lack the overall strength and toughness properties that can be achieved with pieces created using wrought techniques.

To date, most centrifugal forming of aluminum alloys has been carried out using alloys with standard cast aluminum chemistries. Due to differences in alloy composition, articles formed from alloys with standard cast aluminum chemistries are generally incompatible with wrought alloy bodies because the alloys formed by the wrought method and centrifugal forming generally have different physical and mechanical properties. Furthermore, standard cast and wrought aluminum chemistries also include undesirable iron particles which may lower a quality of a protective anodization layer formed on the alloy.

SUMMARY

Embodiments described herein relate generally to aluminum alloys and methods of forming such aluminum alloys such that the substantially all of the beta-AlFeSi particles in the alloys, which are a hindrance to the successful formation of a continuous anodized aluminum oxide layer thereon, is transformed into alpha-AlFeSi particles which do not pose any hindrance to the successful formation of a continuous anodized layer.

In some embodiments, a method comprises providing a molten aluminum alloy selected from the group consisting of 6000 series aluminum alloys comprising chromium (Cr) in a range of 0.001 wt % to 0.05 wt %. The molten aluminum alloy is formed into a formed body having beta-AlFeSi particles. The formed body is solution heat treated at a temperature in a range of 1,025-1,050° F. to form a heat-treated body. The solution heat treating process transforms substantially all of the beta-AlFeSi particles into alpha-AlFeSi particles such that the heat-treated body is substantially free of the beta-AlFeSi particles.

In some embodiments, a cast aluminum alloy article formed from a 6000 series aluminum alloy comprises chromium (Cr) in a range of 0.001 wt % to 0.05 wt %, and AlFeSi particles. Greater than 95% of the AlFeSi particles comprise alpha-AlFeSi particles and less than 1% of the AlFeSi particles comprises beta-AlFeSi particles.

In some embodiments, a cast aluminum alloy article formed from a 6000 series aluminum alloy comprises chromium (Cr) in a range of 0.001 wt % to 0.05 wt % and AlFeSi particles, the AlFeSi particles comprising alpha-AlFeSi particles having an average size in a range of 9-20 microns and an average spacing in a range of 100-250 microns.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
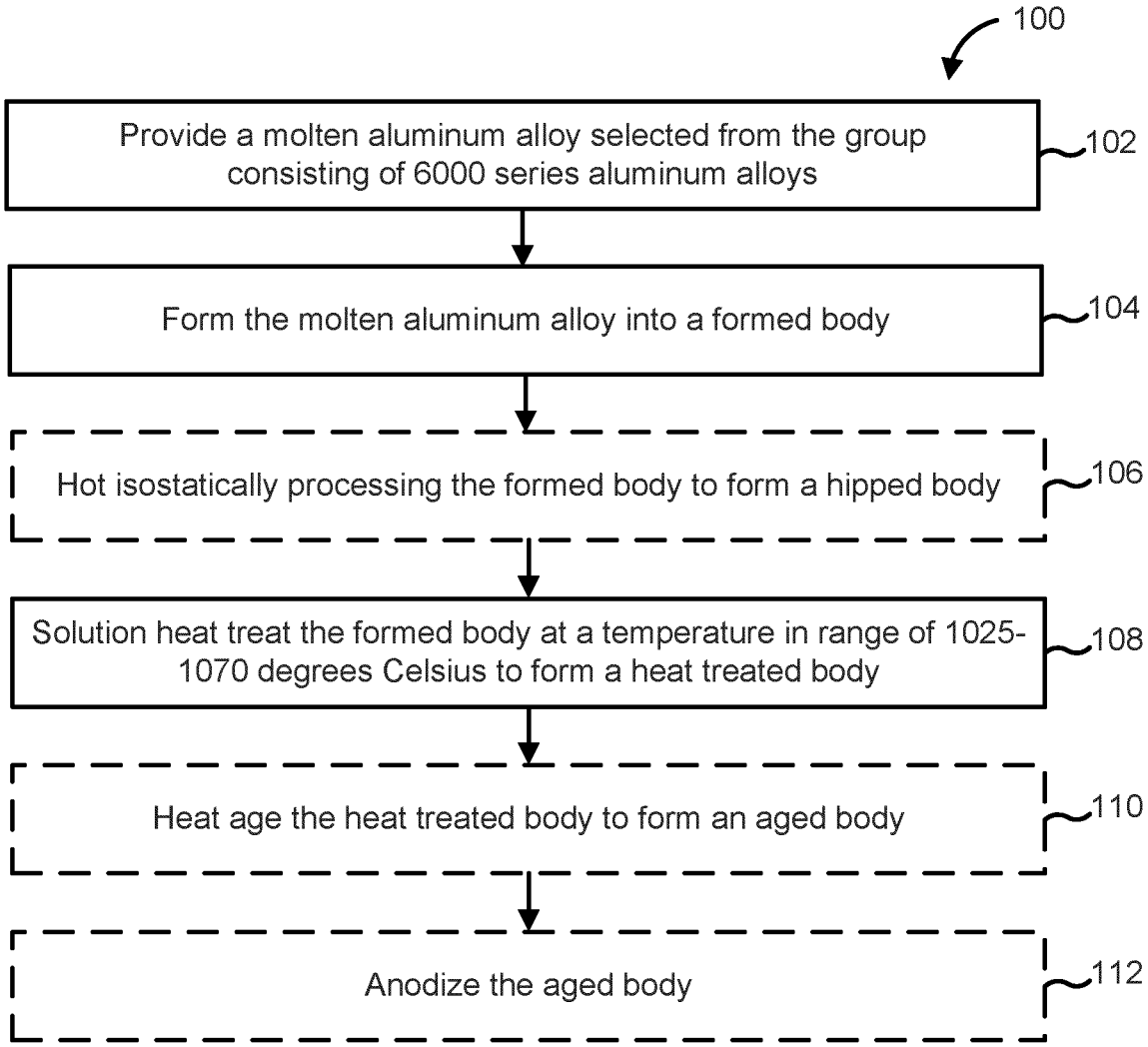
FIG. 1 is a schematic flow diagram of a method for forming an aluminum alloy, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to aluminum alloys and methods of forming such aluminum alloys such that the substantially all of the beta-AlFeSi particles in the alloys, which are a hindrance to the formation of a substantially continuous anodized aluminum oxide layer thereon, is transformed into alpha-AlFeSi particles which do not pose any hindrance to the formation of a substantially continuous anodized layer.

Centrifugal forming (also known as centrifugal casting) is one method which may be used for making alloys and in particular, aluminum alloys. A centrifugally formed alloy body has generally less impurities and porosity than an alloy body produced by static casting. Aluminum pieces produced by centrifugal forming, however, still commonly have a significant amount of porosity and generally do not possess the overall strength and toughness properties that can be achieved with pieces created using wrought techniques. To date, most centrifugal forming of aluminum alloys has been carried out using alloys with standard cast aluminum chemistries. Due to differences in alloy composition, pieces formed from alloys with standard cast aluminum chemistries are generally incompatible with wrought alloy bodies because the alloys formed by wrought methods and centrifugal forming generally have different physical and mechanical properties.

Furthermore, alloys may also include undesirable iron particles which may lower a quality of an anodization layer formed on the alloy. For example, aluminum alloys may be formed using forging or centrifugal forming. Many such alloys include iron that leads to the presence of beta-AlFeSi or beta Al(FeMn)Si particles in the alloy. These plate like particles cause defects or imperfection during the anodization process of such aluminum alloys leading to discontinuities in the anodized layer which can serve as points of corrosion initiation in highly corrosive environments.

Expanding further, the centrifugal forming method has been shown to be able to produce the wrought chemistries of both 6061 aluminum alloy and 7075 aluminum alloy with mechanical properties that approach those of their wrought counterparts. Designations through the Aluminum Association have named these cast equivalents to 6061 and 7075 as 505.0 and 709.0, respectively. While the development of mechanical properties has been successful for these two alloys using the centrifugal process, certain alloy constituents are present for the optimization of mechanical properties for wrought processes and not necessarily for corrosion resistance. A composition of the aluminum alloy may have to be modified to allow formation of a defect-free anodized layer which can be achieved using a composition different from those used for optimum mechanical properties.

The two main elements of series 6000 aluminum alloys are Mg and Si, which combine to form a $Mg_2Si$ precipitate. The presence of the elements Fe, Mn, and Cr, however, allows for the formation of more complex silicides with unique and sometimes detrimental microstructural characteristics to the formation of a continuous anodized layer. One such silicide is the beta-AlFeSi, which has a needle or plate-like structure. The formation of the beta-AlFeSi is strongly dependent on the solidification rate of the casting, with faster solidification rates resulting in lesser or even complete elimination of the phase. For typical casting methods, solidification rates are not rapid enough to prevent the formation of the beta-AlFeSi.

Embodiments, described herein provide for reducing the detrimental effect of these silicides in 6000 series or any other series aluminum alloys by the use of homogenization treatments that result in the phase transformation of the beta-AlFeSi to the alpha-AlFeSi or alpha-Al(FeMn)Si which does not hinder growth of a substantially continuous anodized layer. The presence of beta-AlFeSi may also be reduced by using a base aluminum that has an iron content of less than 0.04 wt % (e.g., in a range of 0.02-0.04 wt %), and/or by including Sr (e.g., in a range of 0.1-0.15 wt % or any other suitable range) in the alloy which promotes formation of the alpha-AlFeSi particles during a forming process of the alloy.

Embodiments of the centrifugally formed aluminum alloys described herein provide several benefits including, for example: (1) having alpha-AlFeSi (e.g., alpha-Al(FeMn)Si) particles which do not hinder anodization and being substantially free of beta-AlFeSi particles; (2) allowing removal of beta-AlFeSi particles by a simple homogenization solution heat treatment process; (3) allowing production of near-net shapes without the need for extensive forging processes to break down silicide structures; (4) having similar mechanical properties as wrought or forged alloys by hot isostatically pressing the centrifugally formed alloy; and (5) allowing growth of a uniform anodization layer on the aluminum alloy.

FIG. 1 is a schematic flow diagram of an exemplary method 100 of forming an aluminum alloy. The method 100 comprises providing a molten aluminum alloy selected from the group consisting of 6000 series aluminum alloys, at 102. In some embodiments, the alloy may include a 6061 aluminum alloy or a 6063 aluminum alloy which is similar to the 6061 alloy but excludes Cu and Cr. In some embodiments, the molten aluminum alloy may include about 0.02-0.04 wt % Fe, 0.5-0.6 wt % Si, 0.16-0.19 wt % Cu, 0.05-0.065 wt % Cr, 1.0-1.1 wt % Mg and at least 98 wt % Al. For example, the molten aluminum alloy may include a 6061 aluminum alloy having a low iron content. In some embodiments, the molten aluminum alloy may be a Al—Mg—Si—Cu—Cr type aluminum alloy including less than 0.04 wt % Fe and at least about 98 wt % Al. In still other embodiments, the molten aluminum alloy includes less than 0.7 wt % Fe and 0.1-0.15 wt % Sr.

Melts may be prepared by heating metal, typically scrap or specially alloyed ingot, in a furnace. If the chemistry of the melt does not meet desired specifications, it may be re-alloyed as necessary with addition of the requisite amounts of individual constituent elements [e.g., strontium (Sr)] therein. These additions may be made to the molten alloy ("melt") in the furnace. The metal which is used to form the melt, whether scrap, alloyed ingot and the like or individual added constituent elements, is collectively referred to herein as "source metal." The chemistry of the alloy (i.e., the amounts of the individual constituent elements) is tightly controlled with respect to the amounts of both major and minor constituents. In some instances, the molten aluminum alloy may be re-alloyed with additions of minor constituents, such as copper (Cu), silicon (Si), magnesium (Mg), manganese (Mn), zinc (Zn) or iron (Fe), as appropriate.

The chemistry of a melt lot may be verified by computerized spectrochemical analysis prior to casting. Melt temperatures may vary with the particular alloy composition and is established such that thorough mixing of the constituents is enabled as well as allowing the proper fluidity for the centrifugal forming process. The temperature used should be low enough to minimize gas pickup, oxidation, and degradation of chemistry. For wrought aluminum alloys of the type that are typically employed in the methods described herein, melt temperatures of about 1,000 to 1,500° F. (537 to 816 degrees Celsius) are common. For example, a 6061 aluminum alloys may be heated to about 1,400° F. to form a melt. There are various methods of heating metal alloys to form the molten alloy. This can generally be accomplished by heating the source metal. In some embodiments, the aluminum alloy is melted in an induction furnace, but other melting methods (e.g., gas furnace, convection melting, blast furnace, kiln, or molybdenum furnace) may be employed. In various embodiments, induction melting may produce relatively low levels of oxides in the resulting melt as well as facilitate thorough mixing of the melted alloy.

At 104, the molten aluminum alloy is solidified into a formed body having beta-AlFeSi particles. For example, the aluminum alloy may be formed using the wrought processes of forming, rolling and/or extruding. In particular embodiments, forming the molten aluminum alloy comprises centrifugally forming the molten aluminum alloy in a mold such that the formed body includes a cast body. The centrifugally forming may comprise rotating the mold at a speed of at least about 500 rpm and/or at a centrifugal acceleration of at least about 30 G.

For example, the melted aluminum alloy may be generally cast by pouring into a mold capable of being rotated at a relatively high speed (e.g., at least about 500 rpm). In some embodiments, the mold may be shaped as a hollow, walled cylinder having an inside diameter of about 4-18 inches less than an outside diameter thereof. The interior and the exterior of the mold may be machined to an appropriate configuration. The mold inside diameter may typically be machined to the appropriate configuration for the casting outside diameter allowing for any thermal contraction of the cast product which may occur during cooling. The mold may be made of a variety of materials (e.g., steel, sand, graphite, and the like) having good dimensional stability and good heat transfer properties.

In some embodiments, the mold may be made of steel, graphite, or other material capable of providing a high chill rate. From a cost/performance standpoint, mild steel and graphite are materials which are particularly suitable for use as mold materials in conjunction with the methods described herein. To facilitate removal of the cast piece, the mold may be coated with a protective insulating release agent such as, for example, Permcoat or Centrificoat release agents. Molds made of graphite are quite suitable for use in the methods described herein. In some embodiments, graphite molds having an inside diameter of about 10-45 inches may be used in the methods described therein. In some instances, the graphite mold may be encased in a larger mild steel mold. Although larger graphite molds may also be employed, it is quite common to centrifugally cast larger pieces using mild steel molds.

The melted alloy may be poured into the mold, which may be pre-heated. The metal may be transferred directly from the melt furnace to a pouring ladle. The metal temperature may be checked just prior to pouring. Metal is poured directly into the prepared centrifugal mold. The surface of the melted alloy may be skimmed to substantially remove any floating impurities such as oxides. According to some embodiments, about 4,000 pounds or less of the melt may be poured from a single lot of alloy, heated and held in an induction furnace over a period of about up to about 8 hours.

The mold may be generally rotated about a vertical axis during the pour. The rotational speed of the mold develops a centrifugal force (e.g., G forces from about 30 to 130 G's). This produces an outward radial force applied to the mold as it is rotated. The centrifugal force is transferred to the molten alloy in the rotating mold through viscous effects. Rotation rates of at least about 500 rpm are commonly employed. The rotational rate may be sufficient to produce G forces of at least about 60 to 70 G. The centrifugal force produces separation of impurities in the melted alloy based on differences in densities. As the melted alloy solidifies, impurities (e.g., oxides, dross, nonmetallic impurities and the like) that have a density generally less than the density of aluminum are forced toward the inside diameter of the casting. To a lesser extent, impurities that have a density generally greater than the density of aluminum are generally forced to the outside diameter of the casting. Without intending to be limited by theory, it is believed that the centrifugal force reduces the amount of impurities and/or shrinkage defects (porosity) in the resulting centrifugally cast alloy body (relative to a statically cast body).

The melted alloy solidifies until substantially no liquid metal remains in the mold. The solidifying casting feeds progressively from the high pressure liquid metal inside the solidifying cylinder until no molten metal remains as the inside diameter becomes solid. Unidirectional chilling of the metal may be assisted by applying a coolant, such as water, to the outside of the mold. During solidification of the molten alloy, the temperature of the mold can drop from about 150 to 800° F., over a period of about 10 to 120 minutes. The solidified alloy (i.e., the centrifugally cast body) may be removed from the mold by overhead crane/hoist or by automatically ejection using conventional mechanical equipment.

In some embodiments, the formed body (e.g., the cast body) may be hot isostatically pressed (HIP) to form a hipped body, at 106. In some embodiments, HIP may include heating the formed body (e.g., the cast body) at a temperature in the range of between 900 to 985° F. while applying an isostatic pressure in a range of 10 to 14 KSI. The HIP body may then be slowly cooled from the hipping temperature or quenched with water (e.g., in a HIP+T6 process).

HIP may produce a further reduction in shrinkage defects, for example, porosity of the aluminum alloy. HIP is described in U.S. Pat. No. 3,496,624 issued to Kerr et al., which is hereby incorporated by reference. HIP includes elevating the temperature of the cast body in an autoclave to a temperature sufficient to achieve a solid state plastic condition and below the melting temperature of the alloy. For aluminum alloys, temperatures of at least about 850° F., for example, in a range of about 900 to 950° F. may be employed. For example, with 6000 series aluminum alloys such as 6061 aluminum temperatures of about 925-985° F. (e.g. in a range of about 950-970° F.) may be employed in the HIP step.

To HIP the formed body, a high external pressure (e.g., via a pressurized gas such as argon or nitrogen) is applied such that a substantially equal force is exerted on each surface of the cast body ("isostatic pressure"). Pressures of at least about 10,000 psi may be utilized. In some embodiments, an isostatic pressures of about 10,000-20,000 psi (e.g., about 14,000 psi) may be employed. Such temperature and pressure may be simultaneously applied for a period of more than 1 hour, (e.g., about 2-6 hours). Such temperature and pressure is intended to reduce the microporosity (i.e., microshrinkage defects) and densify formed body (e.g., the cast body) by eliminating or substantially eliminating voids. Elevated temperature develops a solid state plastic condition in a metal body (e.g., an aluminum alloy body). This results in creep in the formed body where diffusion of atoms to regions of porosity occur forming a fully dense HIP body.

The temperature, pressure and time conditions employed to HIP a particular alloyed product may depend on the alloy composition and to some extent, the size and geometry of the product. Different yet similar HIP procedures may be used as long as micro-porosity is substantially eliminated from the alloy material. In general, if the HIP process is carried out at a lower temperature (relatively), higher pressure and/or longer HIP times may have to be used to render the material substantially free of micropores. As employed herein, substantially free of micropores means a material is substantially free of pores having a largest dimension which exceeds 0.0001 inch (0.1 mil).

Aluminum alloy casting can generally be rendered substantially free of micropores by heating for a period of hours at a temperature of at least about 900° F. (e.g., in a range of about 925 to 1,025° F.) while under an isostatic pressure of at least about 10 KSI. For example, micropores can be substantially removed from 6000 series aluminum alloy material (e.g., 6061 type aluminum) by placing the material into a hipping chamber, heating the material to about 960° F. and holding the material at this temperature for about two hours while a pressure of about 14 to 16 KSI is applied.

At 108, the formed body (e.g., the cast body or the HIP body) is solution heat treating at a temperature in a range of 1,025-1,070° F. to form a heat-treated body. The solution heat treating transforms substantially all of the beta-AlFeSi particles into alpha-AlFeSi particles such that the heat-treated body is substantially free of the beta-AlFeSi particles.

For example, the formed body (e.g. the cast body) or the HIP body may be homogenized by solution heat treating at the temperature range of 1,025-1,070° F. for at least about 2 hours (e.g., about 6-8 hours). The cast or HIP aluminum alloy has beta-AlFeSi plate like particles which hinder the formation of a substantially continuous anodized layer on the aluminum alloy, and therefore results in the aluminum alloy being susceptible to corrosion, especially in highly corrosive environments. Solution heat treatment at a temperature in a range of 1,025-1,070° F. transforms the beta-AlFeSi into spheroid alpha AlFeSi or alpha Al(FeMn)Si particles that do not hinder the growth of a substantially continuous anodization layer on the aluminum alloy. In some embodiments, the solution heat-treated body may be quenched in water or any other fluid (e.g., oils) at a temperature of less than 100° F. In some embodiments, the homogenizing solution heat treatment at 1,025-1,070° F., followed by quenching in water may cause the heat-treated body to have a T4 temper. In other embodiments, the solution heat-treated body (T4) may undergo an aging treatment at a temperature of about 300 to 400° F. for about 2 to 20 hours to create a T6 temper.

In some embodiments, the heat-treated body is heat aged to form an aged body, at 110. For example, the heat aging or age hardening may be performed at a temperature of about 300 to 400° F. for about 2 to 20 hours (e.g., about 325-375° F. for about 4-15 hours).

With respect to aging treatments, it should be noted that the formed body (e.g., the cast body) or the HIP body may be subjected to any suitable under-aging or over-aging treatments, including natural aging. In addition, the aging treatment may include multiple aging steps, such as two or three aging steps. Also, stretching or its equivalent working may be used prior to or after part of any multiple aging steps. For two or more aging steps, the first step may include aging at a relatively high temperature followed by a lower temperature or vice versa. For three-step aging, combinations of high and low temperatures may be employed.

In some embodiments, heat aging treatments may be performed in accordance to MIL-H-6088. Aluminum alloy castings produced by the method 100 or any other method described herein, e.g., 6000 series alloys such as 6061, may be heat aged after the homogenizing solution heat treating step. For example, the heat-treated body may be cooled by quenching in water and subsequently heat aged. The heat-treated body may be heat aged by heating at 300-400° F., typically for about 2 to 20 hours. In some embodiments, an aluminum alloy heat-treated body is heat aged for 5-10 hours at 325-375° F.

Longer times are generally required for heat aging carried out at lower temperatures, e.g., heat aging will typically be carried out for a longer period of time at 300° F. than at 400° F. The heat aging may be conducted for a long enough period of time to achieve the desired physical properties for the cast product, e.g., to increase the elongation of a heat-treated body to at least about 6% and preferably to at least about 8%. For example, desirable cast products can be formed from 6000 series aluminum alloy (e.g., 6061) by the present method by heat aging the solution heat-treated body at 325-375° F. for 7-10 hours.

The body may undergo further mechanical or chemical processing. The exterior surface of the HIP body may be machined or "peeled" away. For example, oxides and/or other impurities may be removed from the surfaces by machining the HIP body. At the same time, machining can be used to form smooth and clean surfaces. The cast product may be rough machined to an envelope slightly larger than the finished part. The inner region of unsound oxides and lower porosity may be removed by machining. In some implementations, the outer skin may also be machined away. Parts will usually be rough machined to an envelope yielding the finished part. Nondestructive testing (e.g., radiographic examination, fluorescent penetrate inspection, ultrasonic testing, etc.) or destructive testing (e.g., samples cut for photomicrographs) may be performed on the HIP body. Tensile specimens of standard proportions (e.g., conforming to ASTM B 557) may be cast with each lot of castings to size in molds representative of the practice used for the castings. Alternatively, specimens may be taken from actual product castings. Metal for the specimens is part of the melt used for the castings and is subjected to any grain refining additions given the metal for the castings. The temperature of the metal during pouring of the specimens should not be lower than that used during pouring of the castings.

In some embodiments, the aged body is anodized, at 112. The anodization may be performed in a sulfuric acid or mixed acid bath using any suitable electrochemical conditions. Since the homogenization solution heat treatment operation at 1,025-1,070° F. transforms substantially all of the beta-AlFeSi particles in the heat-treated body to alpha-AlFeSi or alpha-Al(FeMn)Si particles, a continuous or substantially continuous anodization layer may be formed on the heat-treated body, thereby significantly improving the corrosion resistance of the aluminum alloy or any article formed therefrom.

The method 100 or any other method described herein above may be used to fabricate a variety of resulting products. Such products may include, but are not limited to balls, stators, seals, valve bodies, gears and large flanged bushings. Other products may include turbine and airframe components, medical equipment components, engine run components, high pressure valves and pumps, automotive parts, recreational parts that use premium surface finishes, and the like. In particular embodiments, the method 100 or any other methods described herein may be used to produce aluminum source material for use in semi-conductor manufacturing where a high degree of corrosion resistance is necessary.

The process outlined above may be used for fabricating aluminum alloys chemistries which are traditionally associated with the wrought process. For example, 6000 series wrought aluminum alloys (according to the designation of the Aluminum Association in the United States) or any other source material may be employed in the present method. The 6000 series wrought aluminum alloys include silicon and magnesium in approximate proportions to form magnesium silicide. The 6000 series alloys are generally known for being heat treatable. Alloys in the 6000 series may be formed in T4 temper or may be brought to full T6 properties by artificial heat aging. According to a preferred embodiment, the 6000 series alloys include silicon and magnesium in the ratio of about 0.5:1-2:1. Mg—Si type aluminum alloys ("Al—Mg—Si type alloys"), such as Al—Mg—Si—Cu—Cr type alloys as exemplified by 6000 series alloys, are widely used and favored for their moderately high strength, low quench sensitivity, favorable forming characteristics and corrosion resistance. In some embodiments, the standard 6000 series aluminum alloy is a 6061 aluminum alloy having the composition as outlined in Table 1 below:

TABLE 1

Composition of a 6061 aluminum alloy

| Element | Minimum wt % | Maximum wt % |
|---|---|---|
| Magnesium | 0.80 | 1.20 |
| Silicon | 0.40 | 0.80 |
| Copper | 0.15 | 0.40 |
| Iron | — | 0.70 |
| Zinc | — | 0.25 |
| Manganese | — | 0.15 |
| Titanium | — | 0.15 |
| Other, each | — | 0.05 |
| Other, total | — | 0.15 |
| Aluminum | — | Remainder |

Wrought 6061 aluminum alloys are used extensively in aerospace industries in different shapes and sizes. 6061 aluminum alloys may also be used in the semi-conductor where high purity and protection for corrosion is highly desirable (e.g., semi-conductor fabrication). The production of cylindrical parts using wrought techniques is generally expensive due to the process cost and acceptance standards. The method 100 or any other method described herein may provide a cost effective cylindrical dense cast 6061 aluminum alloy which allows production of a continuous high quality anodization layer by utilizing a combination of centrifugal forming, hot isostatic processing and homogenization heat treatment procedures. The methods described herein may be utilized to produce cast 6061-T6 aluminum alloys for light weight simple or complex cylindrical parts requiring moderate strength and where dimensional stability is desirable during machining, but usage is not limited to such applications.

While alloys described herein are generally described as including 6000 series aluminum alloys, other aluminum alloys may be employed in the methods described herein. For example, in some embodiments, the aluminum alloys may include a Al—Zn-type alloys, such as 7000 series wrought aluminum alloys. 7000 series alloys include zinc as the major alloying element. Other elements such as copper and chromium may be included in small quantities. 7020 and 7075 alloys are two examples of such alloys.

In some embodiments, the aluminum alloy may include an Al—Cu type aluminum alloys, for example, a 2000 Series wrought aluminum alloy. 2000 series alloys include Al—Cu alloys in which copper is the principal alloying element, typically in a range of 2%-4.4% by weight. Solution heat treatment of alloys in the 2000 series may result in mechanical properties similar to, and which may exceed, those of mild steel. 2014, 2019, 2219, 2024 (Al—Cu—Mg—Mn type), 2124 (Al—Cu—Mg—Mn type), 2090,2095 and 2195 are examples of suitable alloys in the 2000 series. Al—Li type aluminum alloys and, in particular, 8000 series wrought aluminum alloys may also be utilized in the methods described herein. Lithium is the principal alloying element in the 8000 series. 8090 is an example of a suitable Al—Zn—Mg—Cu—Cr type alloy from the 8000 series.

Traditionally cast aluminum alloys may be used in the methods described herein. Examples of a suitable cast type aluminum alloys which can be employed include 356, 319, 771, 443, 713, 336, 535, 206, 355, 850 and 851 cast aluminum alloys. A cast alloy body may be produced by the methods described herein with good physical and mechanical properties, such as high strength and/or toughness properties. The tensile strength (i.e., a measure of the breaking stress of a material due to pulling) of an alloy body made by the present method may be in the range of about 22-80 KSI or higher (as determined by ASTM B 557). For example, a 6061-T6 alloy body may be produced by the present method having a tensile strength of at least about 42 KSI (290 MPa) (e.g. 45 KSI or 50 KSI). Furthermore, 6061-T6 alloy body described herein may have AlFeSi particles such that greater than 95% of the AlFeSi particles in the aluminum alloy may include alpha-AlFeSi particles and less than 5% of the AlFeSi particles may include beta-AlFeSi particles. In some embodiments, greater than 99% of the AlFeSi particles comprises alpha-AlFeSi particles such that the article is substantially free of beta-AlFeSi particles. The cast aluminum alloy or an article formed therefrom may have % elongation in a range of 5-15%, a yield strength in a range of 42-44 KSI and an ultimate tensile strength in a range of 44-46 KSI.

The methods described herein may be used to form a cast aluminum alloy article. In some embodiments, the cast aluminum alloy article may be formed from a 6000 series aluminum alloy having AlFeSi particles, such that greater than 95% of the AlFeSi particles (e.g., greater than 99%) include alpha-AlFeSi particles and less than 5% (e.g., less than %) of the AlFeSi particles include beta-AlFeSi particles. In some embodiments, the alpha-AlFeSi particles may have an average size in a range of 9-20 microns and an average spacing in a range of 100-250 microns. The article may have a % elongation in a range of 5-15%, a yield strength in a range of 42-44 KSI and an ultimate tensile strength in a range of 44-46 KSI. In some embodiments, the cast aluminum alloy article may include 0.1-0.15 wt % Sr which may promote formation of alpha-AlFeSi. The aluminum alloy may comprise a 6061 aluminum alloy. The cast aluminum alloy article may be covered with an anodized layer of aluminum oxide.

Experimental Examples

Impact of Low Fe Content and Homogenization Solution Heat Treatment

The impact of reducing an iron content of a 6000 series alloy and solutions heat treatment at temperatures in a range of 1,025-1,070 degrees to cause homogenization of the beta-AlFeSi particles to alpha-AlFeSi particles was observed.

Figure 2B:
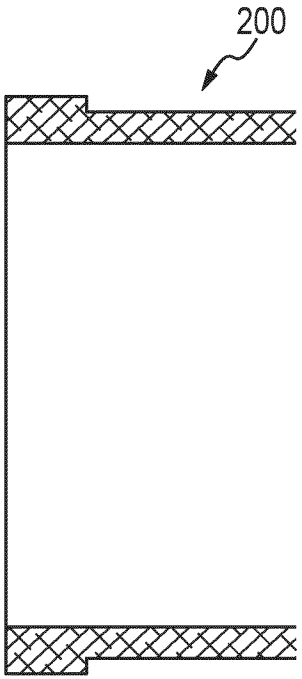
FIG. 2A is a front view and a FIG. 2B is a side cross-section view of a cast aluminum alloy article formed via centrifugal forming and hot isostatic pressing, according to an embodiment.
Figure 2A:
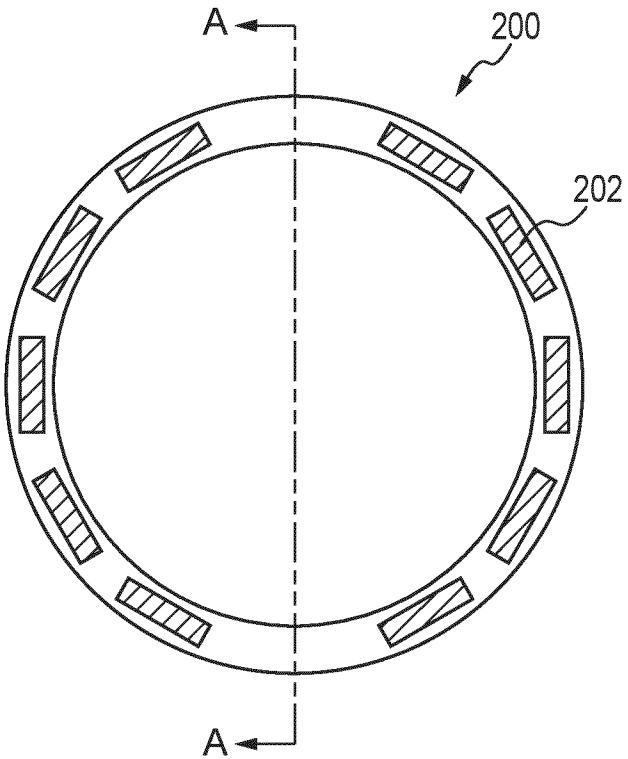

Approximately 1,000 lbs. of the 505.0 alloy which is a 6061 aluminum alloy having less than 0.04 wt % Fe was prepared using a gas fired furnace. A base metal consisting of pure aluminum ingot, pure magnesium and master alloys of Cu, Si, Cr, and Ti, was used to create the chemical compositions summarized in Table II. A series of four centrifugally formed articles were made to produce a finished article 200 shown in FIGS. 2A-B. The formed articles were hot isostatically pressed, machined, and heat treated to a -T6 temper. For the purpose of anodize testing, sample plates 202 approximately 4"×4"×¼" were taken from the mid-wall of the part shown in FIG. 2A.

Homogenization solution treatments were performed at temperatures of 985° F., 1,025° F., 1,050° F., and 1,070° F., followed by quenching in water at a temperature less than 100° F. Aging cycles were identical for all samples. Chemical composition was measured using a Spectro SpectroMaxx optical emission spectrometer (OES) in accordance with ASTM E34. Tensile properties were determined using a Tinius Olsen 60k Super L universal testing machine in accordance with ASTM B557. Anodization and testing was performed per MIL-A-8625, TYPE III, Class 1 was performed on two lots, one each for sulfuric acid and mixed acid. Anodic coatings were sealed using a deionized water bath with a pH between 5.5 and 6.5 and a temperature between 92 and 99° F. Control samples of a 6061-T6 forging and a 505.0 centrifugal casting with the standard chemical composition were included in each anodizing lot for reference. Forging samples were taken from a hand forging purchased according to ASTM B247 with dimensions of 21" OD×13" ID×12" OAL.

Testing included tests for corrosion resistance breakdown voltage, admittance and color. The test for corrosion resistance was an HCl bubble test where coating failure occurs when a continuous stream of $H_2$ bubbles is observed during exposure to a 5 wt % HCl acid solution. Samples were inspected hourly and the test was terminated if samples did not fail over an 8 to 10 hour period. Breakdown voltage was measured according to ASTM D149. Admittance of anodic coatings was measured according to ASTM B457.

TABLE II

Chemical composition of low impurity, standard chemistry and forging samples used for anodizing.

| | Sample 1 (Low Iron) | Sample 2 (Low Iron) | Sample 3 (Standard Composition) | Sample 4 (Forging) | Lower Specification Limit | Upper Specification Limit |
|---|---|---|---|---|---|---|
| Si | 0.52 | 0.59 | 0.68 | 0.65 | 0.4 | 0.8 |
| Fe | 0.028 | 0.035 | 0.257 | 0.191 | | 0.7 |
| Cu | 0.188 | 0.164 | 0.192 | 0.294 | 0.15 | 0.4 |
| Mn | <0.0003 | 0.0007 | 0.058 | 0.029 | | 0.15 |
| Mg | 1.08 | 1.07 | 1.03 | 0.92 | 0.80 | 1.20 |
| Cr | 0.061 | 0.053 | 0.148 | 0.289 | 0.04 | 0.35 |
| Zn | <0.001 | <0.001 | 0.021 | 0.04 | | 0.25 |
| Ti | 0.062 | 0.044 | 0.065 | 0.021 | | 0.15 |
| Al | 98.02 | 98.027 | 97.474 | 97.516 | | |

Due to the size, shape, and high transformation temperature of the iron containing beta-AlFeSi silicides, the iron content of the base material was targeted as the primary cause of anodize layer failures. The use of high temperature solution treating or homogenizing cycles was also deemed to be an important part in decreasing the amount of beta-AlFeSi silicides in the microstructure. In the preparation of the low impurity heat of 505.0, the iron content was significantly reduced in Samples 1 and 2, as compared to the standard chemistry and of a typical forging sample as shown in Table II. Compared to the standard chemical composition (Sample 3) and a forging (Sample 4), the low iron castings had an iron contact which is an order of magnitude lower. With strength properties of secondary importance, the copper content was held towards the lower end of the specification. Purity being of primary importance, the elements of Mn, Cr, and Fe were minimized as far as the specification or raw materials allowed.

Figure 3B:
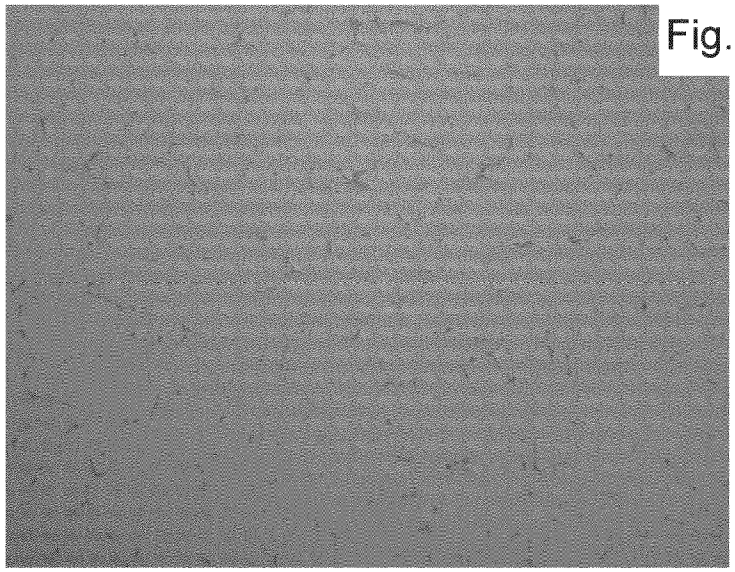
FIG. 3B is a photomicrograph of a centrifugally formed 6061 aluminum alloy with low iron chemical composition (sample 1) following solution treatment at 985° F. and aging cycle, viewed at 100× magnification.
Figure 3D:
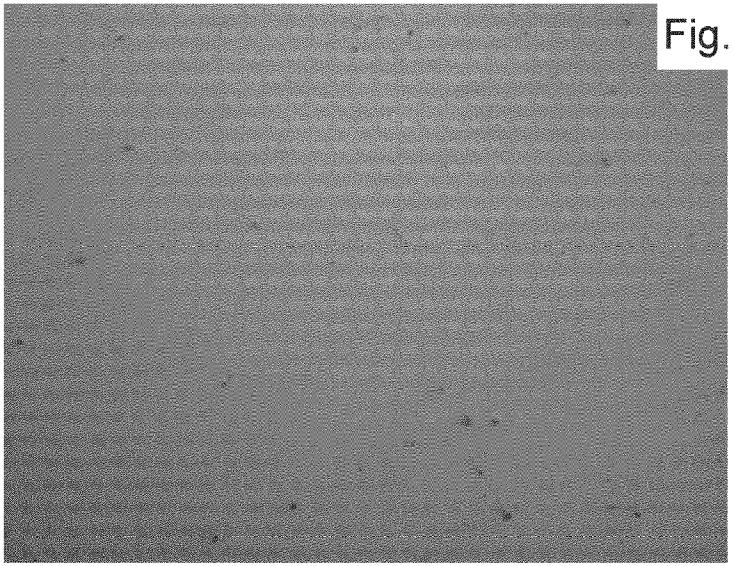
FIG. 3D is photomicrograph of sample 1 following solution treatment at 1,050° F. and aging cycle viewed at 100× magnification.
Figure 3A:
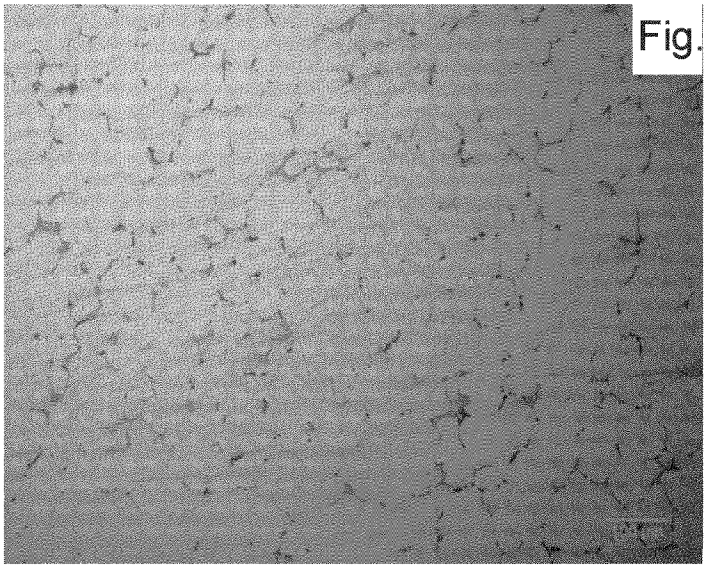
FIG. 3A. is a photomicrograph of a portion of a centrifugally formed 6061 aluminum alloy with a higher iron standard chemical composition (sample 3) following solution treatment at 985° F. and aging cycle at a magnification of 100×.
Figure 3C:
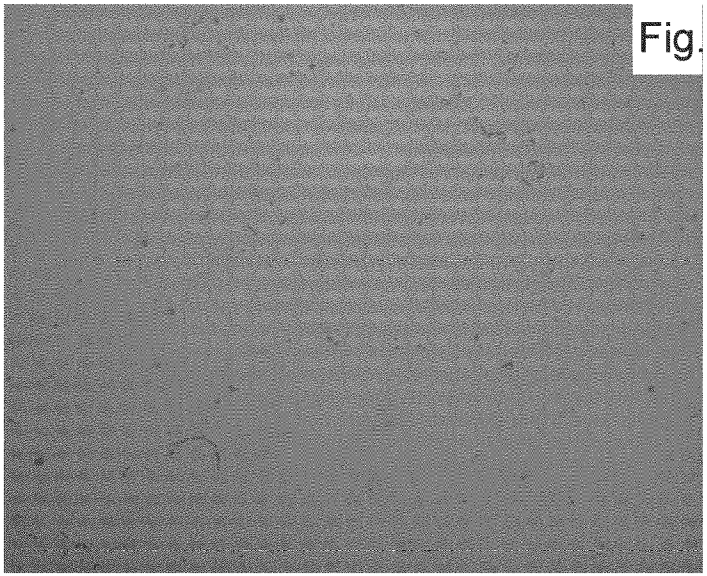
FIG. 3C is a photomicrograph of sample 1 following solution treatment at 1020° F. and aging cycle viewed at 100× magnification.

The microstructures of the low impurity chemistry (Sample 1), solution treated at 985° F., contained both the alpha and beta-AlFeSi silicides as observed in the photomicrograph of FIG. 3A. The amount of both alpha-Al(FeMn)Si and beta-AlFeSi silicides was significantly reduced as compared to the microstructure of the standard chemical composition (Sample 3) shown in FIG. 3B. Following homogenization at 1,020° F., the amount of beta-AlFeSi was minimal and spheroidization of second phase particles was evident as observed from FIG. 3C. At temperatures of 1,050° F. and 1,070° F., beta-AlFeSi was not present, with only spheroidized alpha-Al(FeMn)Si present as observed from the photomicrograph of FIG. 3D.

Figure 4:
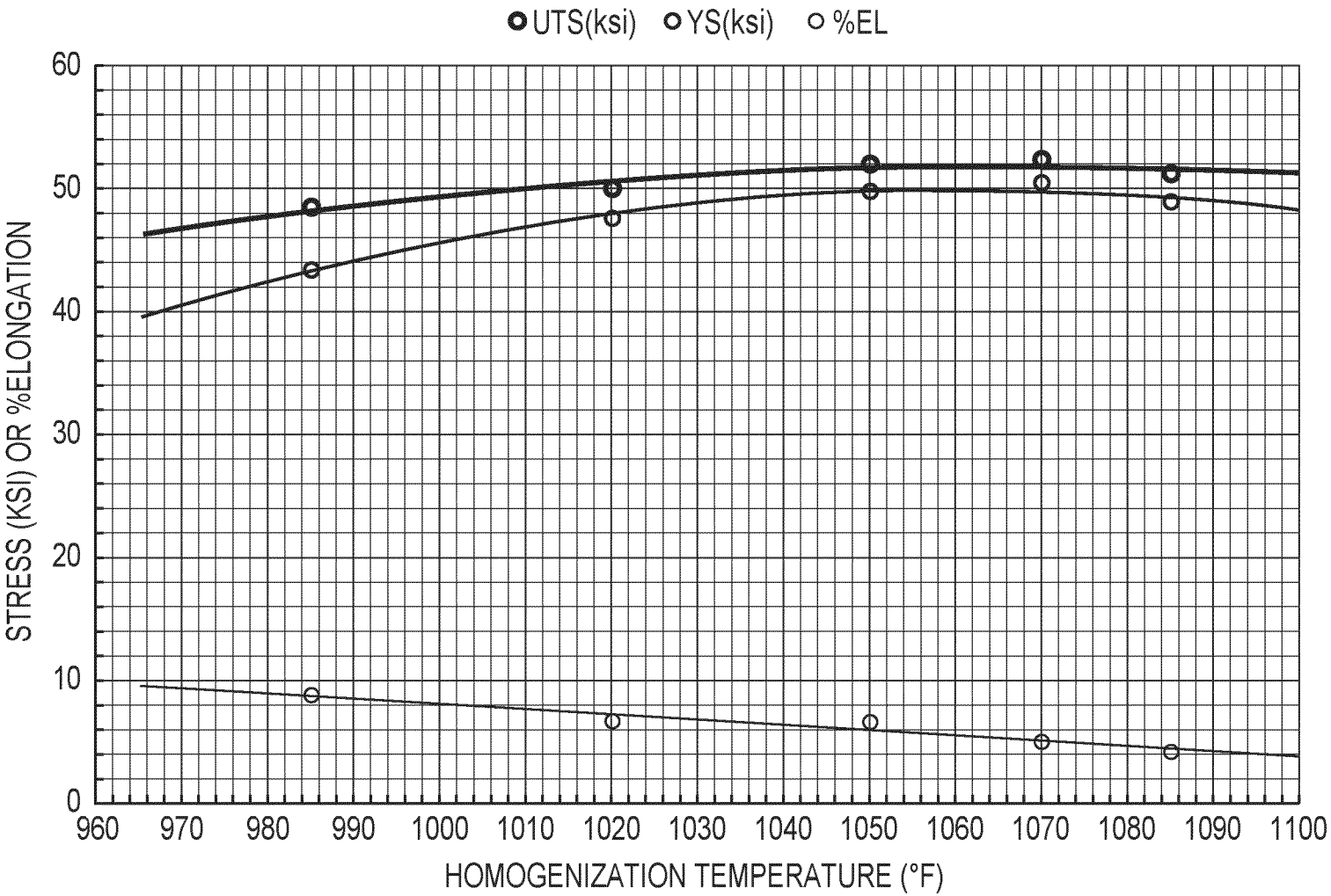
FIG. 4 are plots of tensile properties over the homogenization temperature range between 985° F. and 1,085° F. for sample 3.
Figure 5:
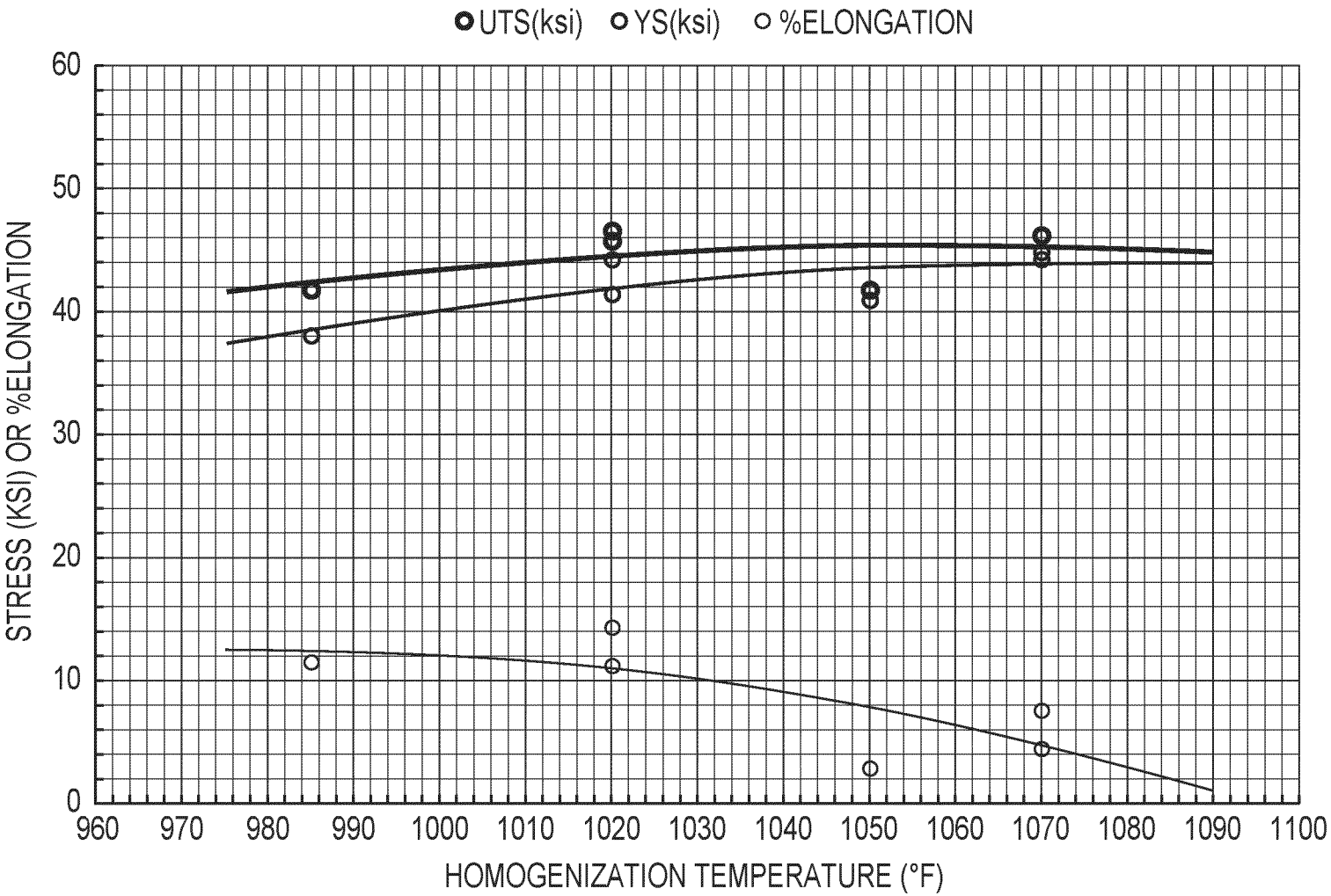
FIG. 5 are plots of tensile properties over the homogenization temperature range between 985° F. and 1,070° F. for sample 1.

Mechanical Properties:

Mechanical properties over the homogenization temperature range of interest for the standard and the low impurity alloys are shown in FIGS. 4 and 5, respectively. The standard chemical composition showed peak strength developing at the homogenization temperature of 1,050° F., but also a steady decline in ductility with increased temperatures. The low iron alloy showed peak strength developing sooner at a temperature of 1,020° F., while ductility remained the same until a decrease was seen at approximately 1050° F.

Anodization:

Anodization tests were performed to investigate the effect of chemical composition, homogenization temperature, processing method, and anodizing method. The centrifugally formed 6061 using the standard composition generally does not possess corrosion resistance necessary for use in the typical corrosive environment of semiconductor processing equipment. The use of the low iron chemical composition in conjunction with homogenization temperatures above 1,020° F., however, demonstrated anodized properties greater than those from forged 6061-T6, as observed from the following electrochemical tests.

Figure 6:
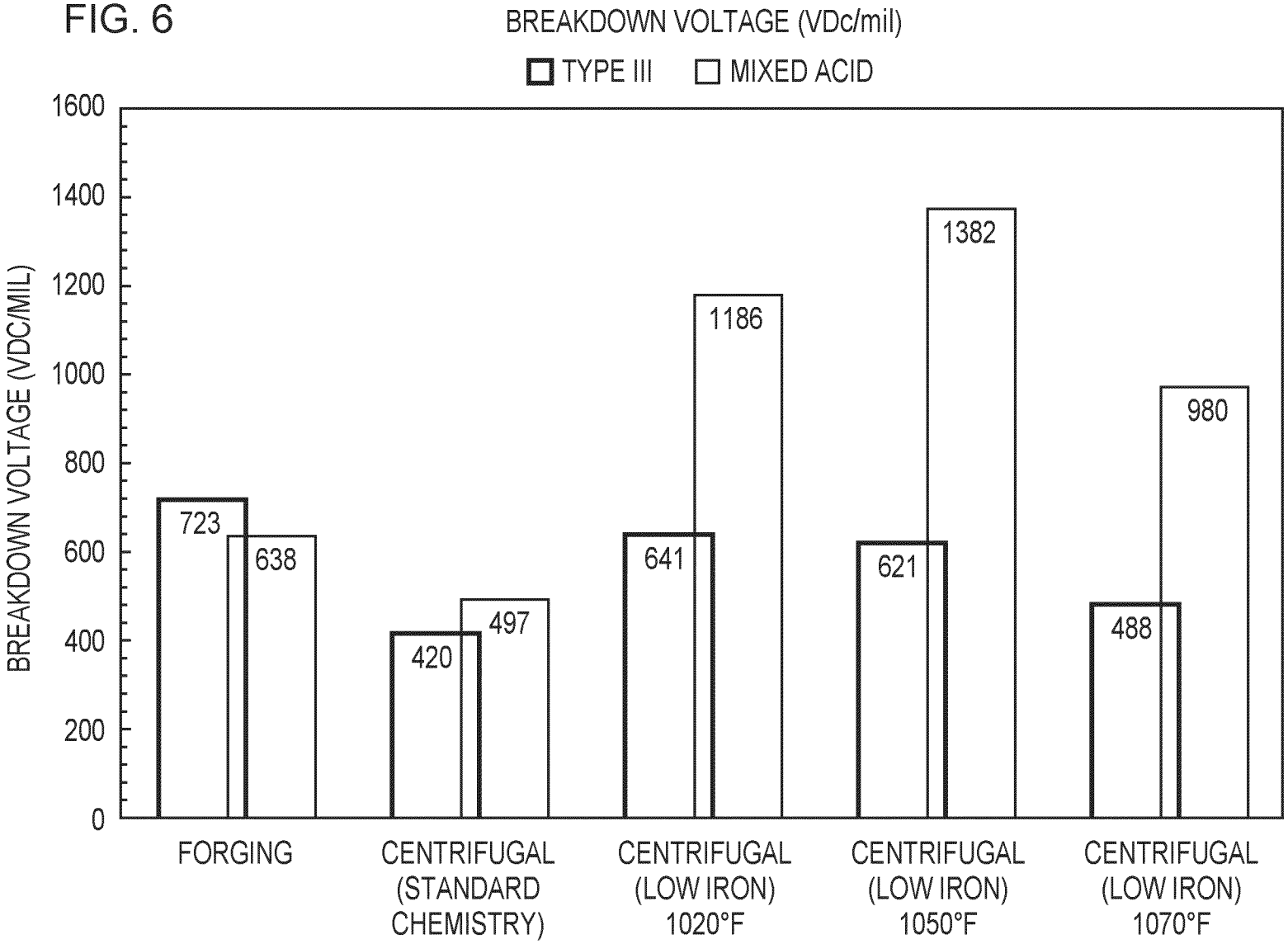
FIG. 6 are plots of dielectric strengths of the centrifugally formed low iron 6061 aluminum alloy (sample 1) homogenized between 1,020° F. and 1,070° F., a forged 6061 aluminum alloy (sample 4) and the centrifugally formed standard chemistry aluminum alloy 6061 (sample 3).

Dielectric Strength (Breakdown Voltage):

The dielectric strength is the electrical strength of a material as an insulator and is measured as the maximum voltage applied to a material without causing it to break down. It is expressed as the breakdown voltage divided by the thickness of the insulating layer, or volts per mil. High quality anodized layers possess high values of dielectric strength or breakdown voltages per mil. Typical industry standards require a minimum of 1600 V at 0.0025" thickness (640V/mil). FIG. 6 summarizes the dielectric strengths measured for the centrifugally formed low iron 6061, the forged 6061-T6, and the centrifugally formed standard chemistry 6061. Breakdown voltage was similar for all samples anodized using the sulfuric acid, Type III method. Mixed acid anodization of the centrifugally formed low impurity 6061, however, produced breakdown voltages nearly double that of the forged 6061. Peak values occurred for centrifugally formed low impurity samples homogenized between 1,020° F. and 1,050° F.

Figure 7:
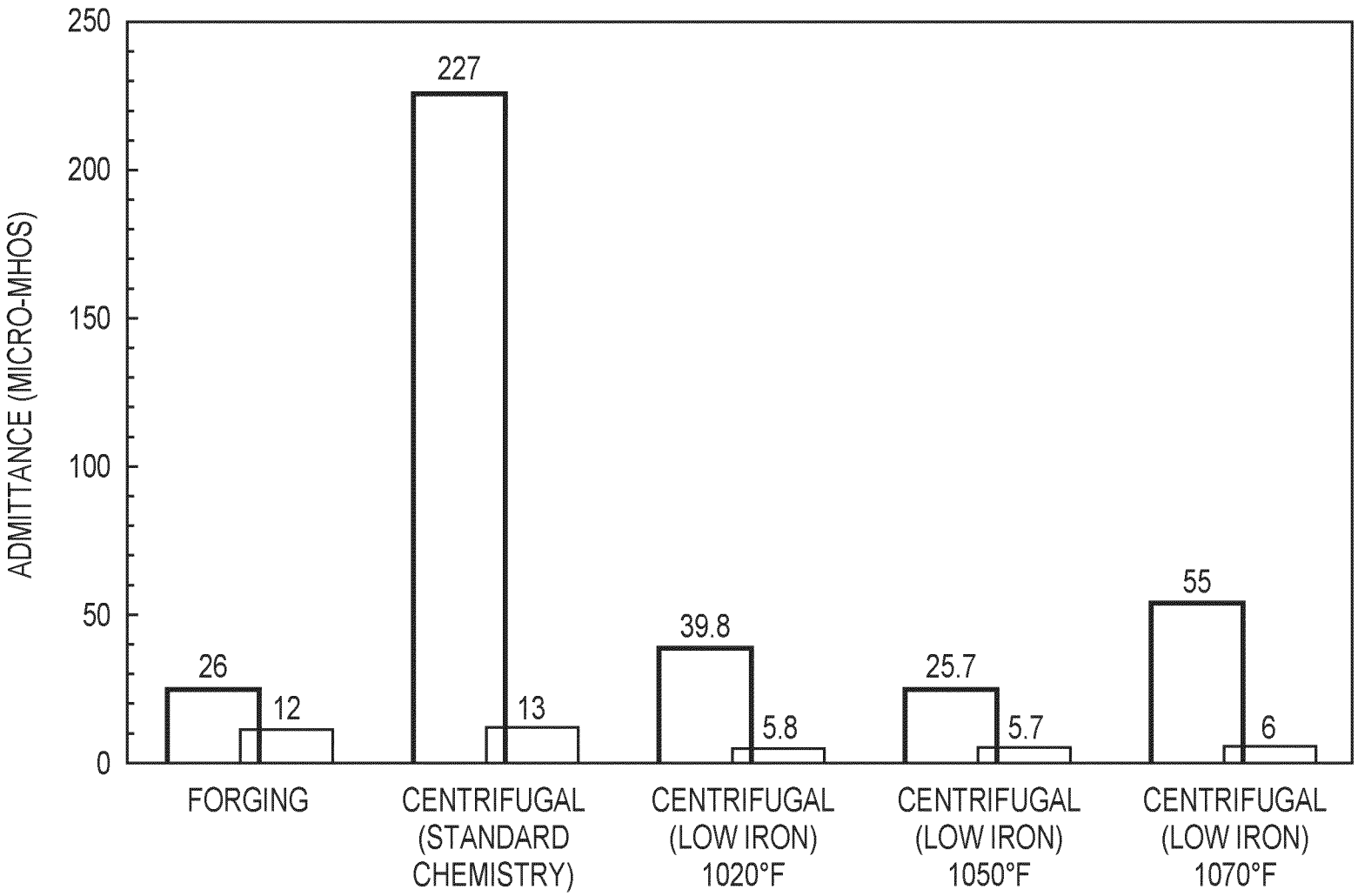
FIG. 7 are plots of admittance of the centrifugally formed low iron 6061 aluminum alloy (sample 1) homogenized between 1,020° F. and 1,070° F., the centrifugally formed standard chemistry 6061 aluminum alloy (sample 3) and the forged 6061 aluminum alloy (sample 4).

Admittance:

The admittance of an anodized layer is the measure of how easily the layer allows an electrical current to flow. The lower the number, the better the insulating quality of the anodized layer. Typical industry standards require admittance to be lower than 500 μMhos. The centrifugally formed 6061 with the standard chemical composition was an order of magnitude greater than any other sample when anodized using sulfuric Type III methods, FIG. 7. The low iron 6061 produced similar values to the forging when using the sulfuric Type III methods. Using the mixed acid anodization, the centrifugally formed low iron 6061 produced the lowest numbers, approximately half those of the forged 6061. Similar to the findings with the dielectric strength, homogenization of the low iron 6061 at temperatures between 1,020° F. and 1,050° F. produced the lowest admittance.

Figure 8:
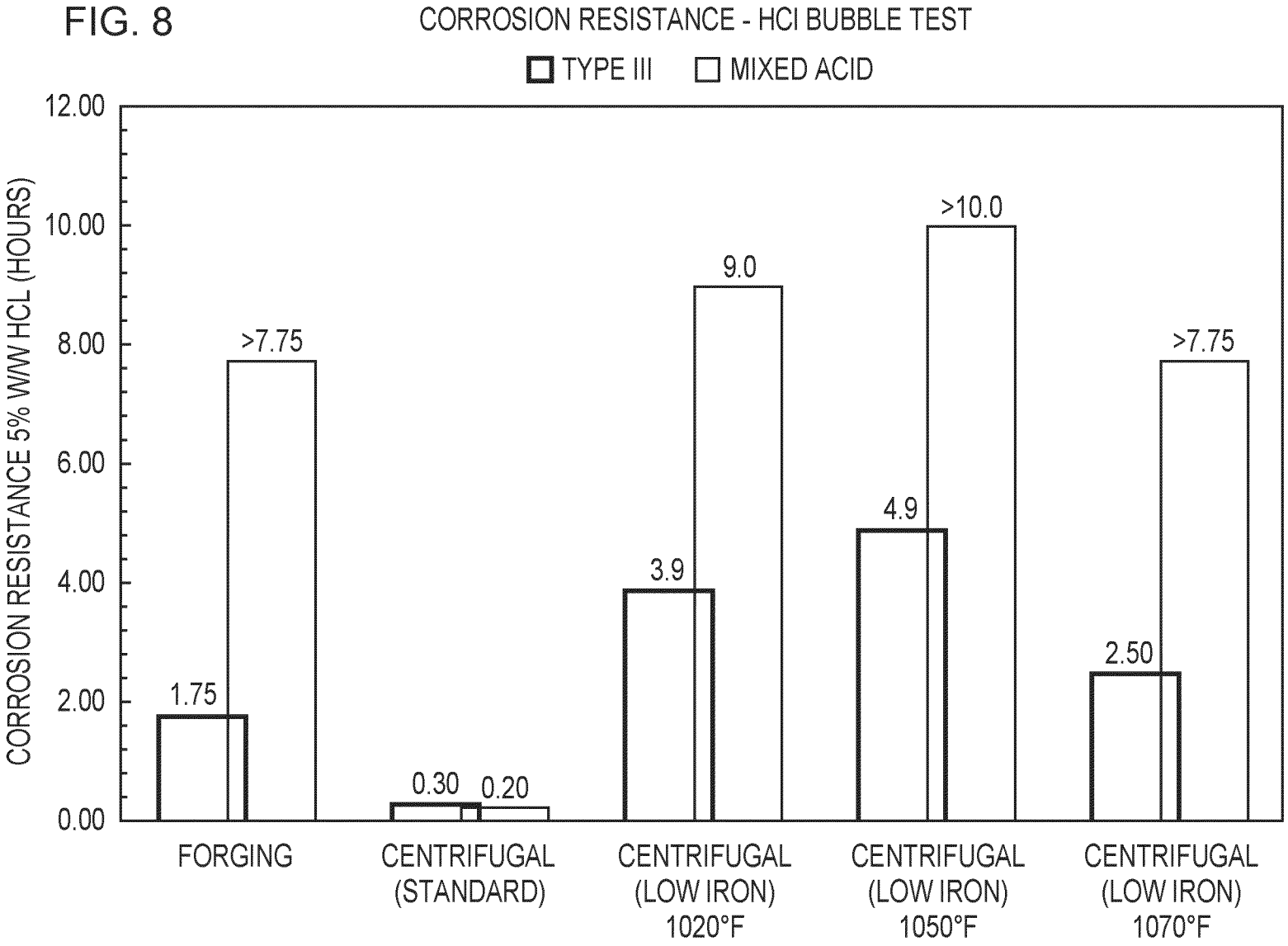
FIG. 8 are plots of corrosion resistance measured by the HCl bubble test of the centrifugally formed low iron 6061 aluminum alloy (sample 1) homogenized between 1,020° F. and 1,070° F., the forged 6061 aluminum alloy (sample 4) and the centrifugally formed standard chemistry 6061 aluminum alloy (sample 3).

Corrosion Resistance: Corrosion resistance as measured by use of the HCl bubble test is shown in FIG. 8. Typical industrial standards are a minimum of 1 hour for forged 6061 and a minimum of 4 hours for 6061 plate material. For the sulfuric Type III anodization, the centrifugally formed low iron 6061 exhibited an improvement over the forged material specifically when homogenized between the temperatures of 1,020° F. and 1,050° F. Peak performance was also found in this temperature range for anodization using mixed acid, where failure was not observed after 10 hours of exposure.

Homogenization Treatment of 505.0 Centrifugally Cast Alloy

A series of four centrifugally formed samples were heat treated at higher solution treating temperatures of up to 1,070° F. in an attempt to decrease the size of second phase silicide particles. At higher temperatures, the normally present beta-AlFeSi phase (plate-like particles) are transformed to alpha-AlFeSi (rounded particles). With the higher homogenization temperatures, the risk of eutectic melting increases, which can occur at a temperature as low as 1,080° F. Eutectic melting has been observed in samples homogenized at a temperature of 1,085° F. However, minimal change in microstructure is observed above 1,070° F., therefore, this temperature of 1,070° F., was used as the maximum temperature to homogenize a 505 alloy centrifugally.

Figure 9:
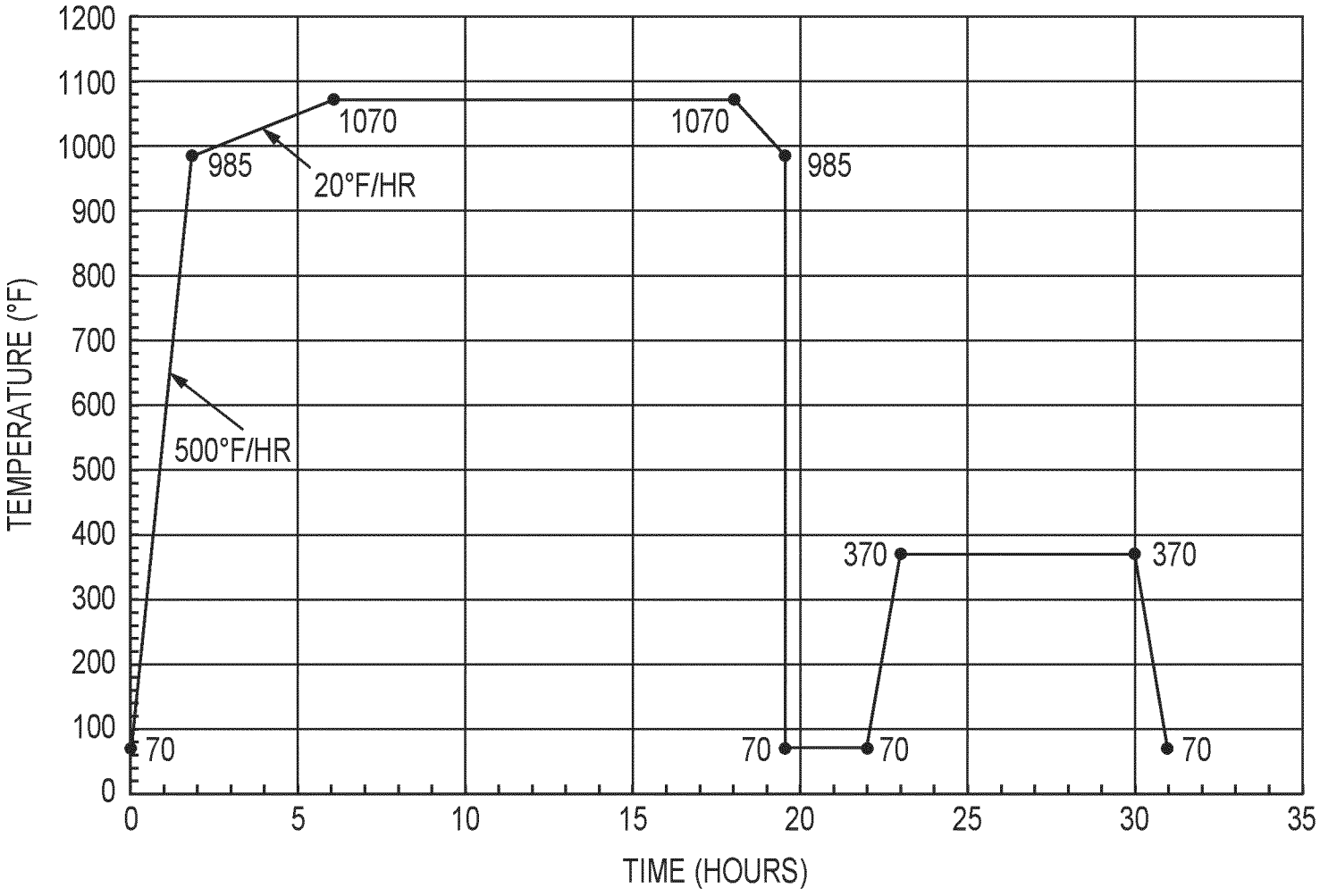
FIG. 9 is a plot of an example heat treatment cycle performed on a HT185103 aluminum alloy which comprises a 6061 aluminum alloy that has an iron content of about 0.28 wt %.

Four samples of HT185103, centrifugally formed on a copper die, were heat treated as complete cross-sections measuring approximately 5" wide, 12" high, and 1½" in thickness. Samples were heat treated according to the cycle shown in FIG. 9. Metallographic samples were prepared using a Leco SS-1000 grinder/polisher to a minimum 1 μm finish. Micrographs were taken in the unetched condition using an Olympus CK40M microscope equipped with a DP-10 camera. ImageJ software was used for scale bars and all measurements of the micrographs.

Figure 10B:
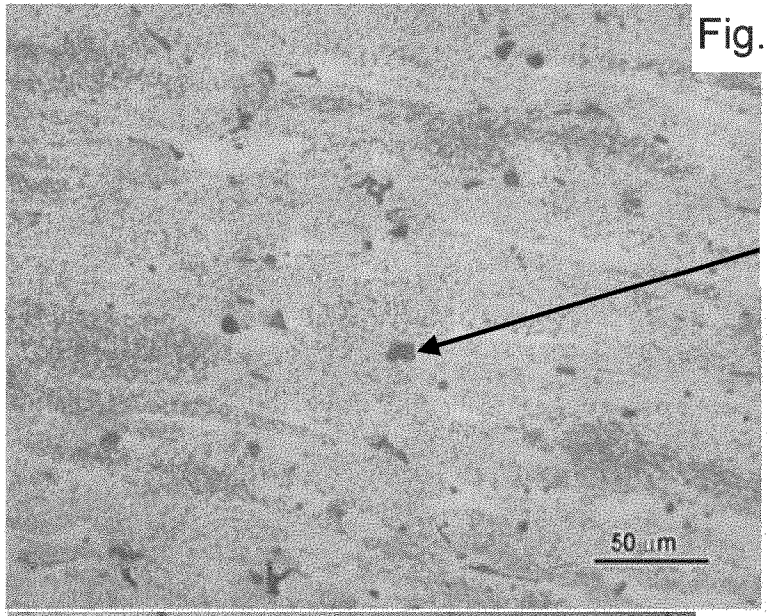
FIG. 10B is a photomicrograph of an anodized 6061 forging sample illustrating the more rounded and finer alpha-AlFeSi particles following homogenization, the largest measuring about 8 μm.
Figure 10D:
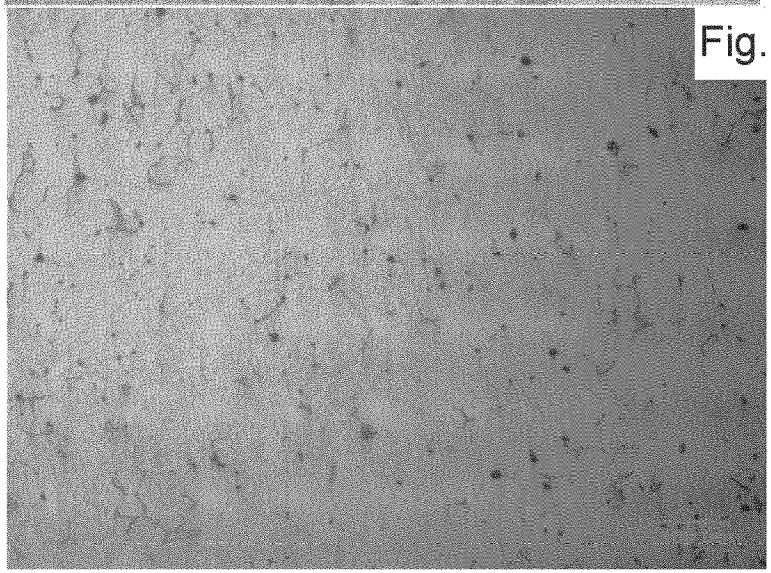
FIGS. 10D, 10E, 10F and 10G are photomicrographs showing microstructures of various centrifugally formed 6061 aluminum alloys homogenized at a temperature of 1,070° F.
Figure 10A:
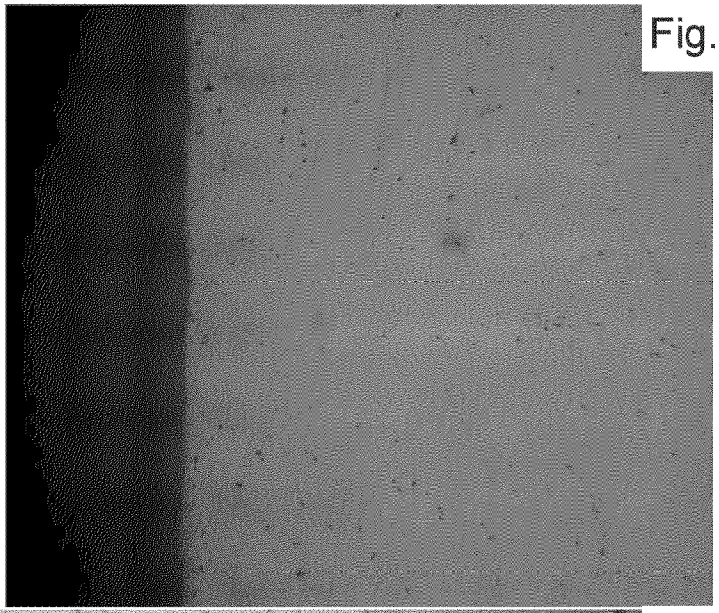
FIG. 10A is a photomicrograph showing the microstructure of an anodized 6061 forging sample.
Figure 10C:
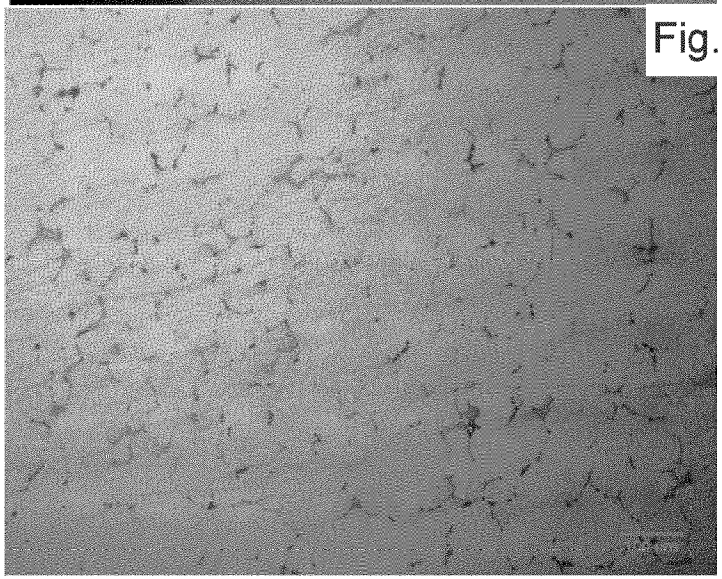
FIG. 10C is a photomicrograph of microstructures of centrifugally formed 6061 aluminum alloy subjected to standard T6 heat treatment and solution heat treated at 985° F.
Figure 10F:
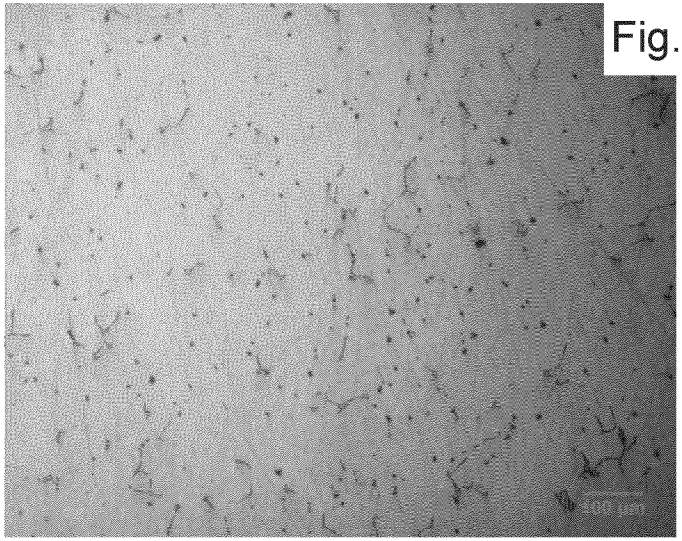
Figure 10E:
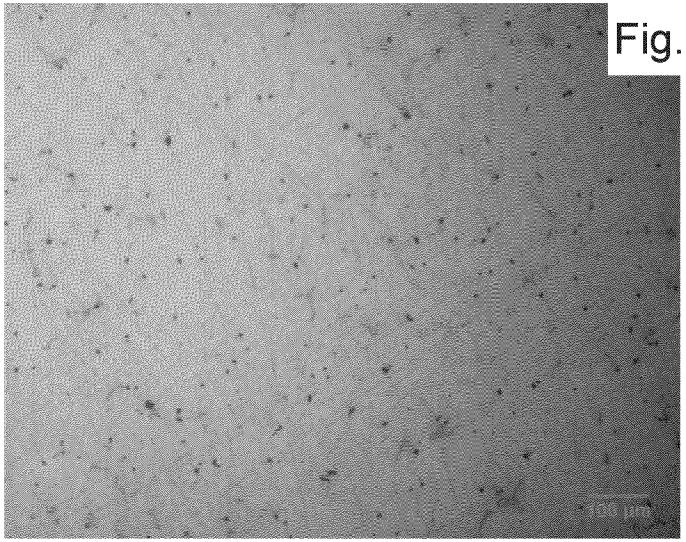
Figure 10G:
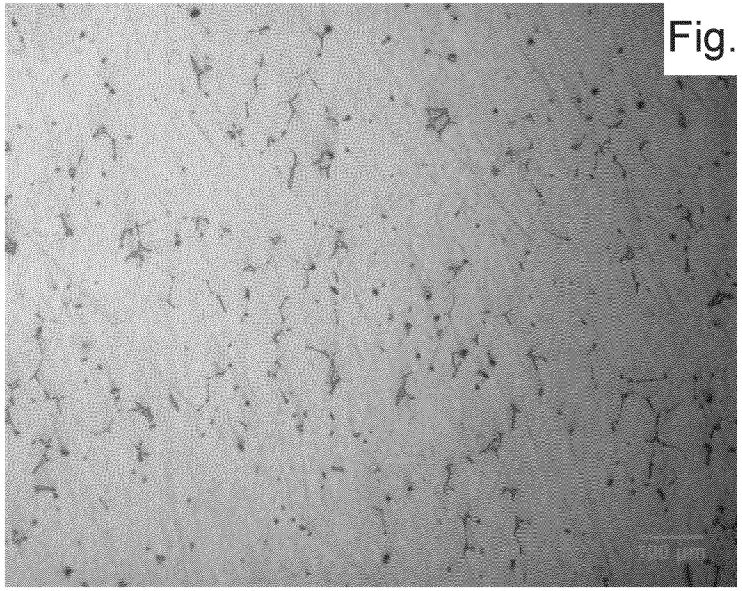

The metallographic analysis of the AlFeSi particle size is shown in Table III. There are three main categories: centrifugally formed with the standard 985° F. solution heat treatment, centrifugally formed with a 1,070° F. homogenization treatment, and a forging sample. The standard processing with a 985° F. solution treatment produced a microstructure, FIG. 10A, with the plate-like beta-AlFeSi intermetallic particles still present, as well as the Chinese-script $Mg_2Si$ particles. On average the average particle length of the plate-like beta-AlFeSi was 16 and 21 μm for two different samples. The standard deviation was the highest of all the samples and contained the largest particles of all the different groups.

TABLE III

Size distribution of alpha-AlFeSi particles in various aluminum alloys

| | 985° F. Solution | | 1,070° F. Homogenization | | | | |
|---|---|---|---|---|---|---|---|
| Reading No. | SN1 (μm) | SN2 (μm) | SN1 (μm) | SN2 (μm) | SN3 (μm) | SN6 (μm) | Forging (μm) |
| 1 | 17.3 | 26.8 | 17.6 | 10.6 | 7.1 | 7.4 | 7.2 |
| 2 | 12.0 | 26.3 | 13.7 | 11.2 | 18.5 | 12.2 | 2.7 |
| 3 | 15.9 | 11.3 | 19.1 | 8.7 | 12.1 | 7.6 | 3.8 |
| 4 | 17.0 | 26.0 | 11.8 | 6.2 | 4.8 | 12.5 | 4.0 |
| 5 | 23.4 | 9.6 | 10.0 | 8.0 | 5.0 | 10.0 | 3.7 |
| 6 | 19.7 | 15.4 | 8.2 | 7.7 | 8.8 | 6.6 | 7.3 |
| 7 | 7.6 | 30.8 | 16.6 | 4.2 | 10.4 | 8.7 | 7.5 |
| 8 | 17.4 | 38.6 | 8.5 | 9.3 | 10.8 | 13.1 | 3.9 |
| 9 | 15.1 | 15.0 | 5.2 | 9.0 | 14.7 | 11.8 | 3.2 |
| 10 | 17.0 | 22.1 | 8.30 | 11.0 | 8.3 | 8.2 | 5.7 |
| 11 | 7.7 | 21.1 | 8.5 | 15.4 | 11.4 | 11.7 | 3.9 |
| 12 | 18.6 | 10.0 | 15.3 | 19.5 | 7.4 | 7.0 | 3.7 |
| 13 | 10.1 | 14.7 | 11.7 | 8.5 | 11.2 | 13.9 | 5.5 |
| 14 | 12.9 | 28.1 | 6.3 | 11.0 | 19.7 | 10.0 | 3.2 |
| 15 | 27.9 | 22.8 | 13.0 | 12.9 | 10.9 | 6.1 | 3.3 |
| Average | 16.0 | 21.2 | 11.6 | 10.2 | 10.7 | 9.8 | 4.6 |
| SD | 5.5 | 8.5 | 4.2 | 3.7 | 4.3 | 2.6 | 1.6 |
| Min | 7.6 | 9.6 | 5.2 | 4.2 | 4.8 | 6.1 | 2.7 |
| Max | 27.9 | 38.6 | 19.1 | 19.5 | 19.7 | 13.9 | 7.5 |

The homogenization at 1,070° F., produced the microstructures shown in FIGS. 10B-10E. Still present in all of the four samples were the Chinese-script $Mg_2Si$ particles. However, the plate-like beta-AlFeSi transformed to the more rounded, spheroidized alpha-AlFeSi. These particles were significantly reduced compared to the plate-like particles of the standard material produced at 985° F. On average, the particle diameter was 10.6 μm, with a lower standard deviation and narrower distribution. The maximum particle size for all for samples was measured at 19.7 μm.

The forging sample, which served as the standard material typically used in this anodize application, contained particles with an average diameter of 4.6 μm and a standard deviation of 1.6 μm. The maximum particle size was measured to 7.5 μm. The microstructure of the centrifugally formed material differed significantly from the forged 6061 material in both the $Mg_2Si$ and the intermetallic AlFeSi particles. The $Mg_2Si$ script-like particles were present along grain boundaries and triple points, and remained unchanged through the homogenization process. Given the absence of any plastic deformation process, these structures will likely always be part of the centrifugally formed 505 microstructure. The use of the 1,070° F. homogenization, however, changed the morphology of the plate-like beta-AlFeSi to the spheroidized alpha-AlFeSi.

Impact of Strontium in Formation of Alpha-AlFeSi

In addition to homogenization treatments to deal with the issue of beta-AlFeSi, reducing the amount of iron in the alloy may also reduce the amount of intermetallic AlFeSi in the microstructure. The specification for the alloy allows a maximum of 0.70 wt % Fe and the iron content of HT185103 was 0.26 wt %. Previous anodizing performance success with a centrifugally formed 6063 alloy was likely due to lower iron levels (about 0.07 wt %) and a reduction in the amount of intermetallic AlFeSi particles. In addition to reducing iron content as a means to reducing the plate-like beta-AlFeSi, microstructure modifiers such as strontium may be used to promote the formation of alpha-AlFeSi over the plate-like beta-AlFeSi during the forming process.

A total of four centrifugal formings were produced using a P0202 aluminum ingot as a base material. Two formings were produced to the 505.0 chemical specification and the remainder produced with varying amounts of strontium. The castings were poured on a chromium-copper die insert under similar condition, as previously described herein. The chemical composition was measured using a Spectro SpectroMaxx OES spectrometer. The distribution of $2^{nd}$ phase particles was measured by the line intercept method. The average distance between particles was measured for at least 5 line segments covering at least ¾ the width of a micrograph taken at 100×. Table IV lists the various materials tested and process variables thereof.

TABLE IV

Material type and process variables of anodized samples

| S. No. | Serial No. | Chemistry | Homogenization Treatment |
|---|---|---|---|
| 1 | 185103-F3 | 505.1 Ingot | Standard |
| 2 | Forging | — | Unknown |
| 3 | 186600-SN1 | P202 Base | Standard |
| 4 | 186600-SN3 | P202 Base | Standard |
| 5 | 186600-SN2 | P202 Base with 0.1 wt % Sr | Standard |
| 6 | 186600-SN4 | P202 Base with 0.15 wt % Sr | Standard |

The 505.1 (6061) alloy does not have a controlled iron range, but instead a maximum limit of 0.70 wt %. The 505.0 ingot typically is within the range of 0.2 and 0.25 wt % iron.

The amount of script-like particles was significantly decreased by the use of P0202 aluminum ingot as a base. Using a solution treatment temperature of 1,025° F., the FeMgSi silicide appears homogenized in all of the samples using the P0202 ingot. The use of the 0.15 wt % Sr had the greatest affect in producing a material with the finest distribution of homogenized $2^{nd}$ phase alpha-AlFeSi particles. Furthermore, the impact of homogenization at 1070° F. on the distribution of alpha-AlFeSi particles was studied. Table V lists the various materials tested and process variables thereof. Table VI lists the chemical compositions of HT186600 castings, standard composition sample and forging samples. Table VII lists the distribution of $2^{nd}$ phase alpha-AlFeSi particle sizes following homogenizing heat treatments at 1025 and 1070° F. Tale VIII list average distances between alpha-AlFeSi particles following heat treatments.

TABLE V

Material type and process variables of anodized samples

| S. No. | Serial No. | Chemistry | Homogenization Treatment |
|---|---|---|---|
| 1 | Forging | Unknown | Standard |
| 2 | 186600-SN1 | P0202 base | 1,070 degrees F. |
| 3 | 186600-SN3 | P0202 Base | 1,070 degrees F. |
| 4 | 185103-F3 | 505.1 Ingot | Standard |
| 5 | 186600-SN4 | P202 Base with 0.15 wt % Sr | 1,070 degrees F. |
| 6 | 186600-SN2 | P202 Base with 0.1 wt % Sr | 1,070 degrees F. |

TABLE VI

Chemical composition (wt %) of HT186600 castings, standard composition sample, and forging samples.

| Element | 186600-SN1 (casting) | 186600-SN2 (casting) | 186600-SN3 (casting) | 186600-SN4 (casting) | 185103 (release) | Forging | Lower Spec. Limit | Upper Spec. Limit |
|---|---|---|---|---|---|---|---|---|
| Si | 0.5 | 0.6 | 0.59 | 0.56 | 0.68 | 0.65 | 0.4 | 0.8 |
| Fe | 0.032 | 0.034 | 0.035 | 0.033 | 0.257 | 0.191 | | 0.7 |
| Cu | 0.186 | 0.165 | 0.164 | 0.151 | 0.192 | 0294 | 0.15 | 0.4 |
| Mn | 0.0012 | 0.0006 | 0.0007 | 0.0007 | 0.058 | 0.029 | | 0.15 |
| Mg | 0.93 | 1.10 | 1.07 | 0.99 | 1.03 | 0.92 | 0.8 | 1.20 |
| Cr | 0.06 | 0.054 | 0.053 | 0.052 | 0.148 | 0.289 | 0.04 | 0.35 |
| Ni | 0.0025 | <0.0004 | <0.0004 | <0.0004 | 0.01 | 0.0065 | | |
| Zn | <0001 | <0.001 | <0.001 | <0.001 | 0.021 | 0.04 | | 0.25 |
| Ti | 0.054 | 0.047 | 0.044 | 0.20 | 0.065 | 0.021 | | 0.15 |
| Sn | <0.001 | <0.001 | <0.001 | <0.001 | 0.018 | <0.001 | | |
| Ag | 0.0007 | <0.0001 | <0.0001 | <0.0001 | 0.0021 | 0.0034 | | |
| Be | 0.0002 | 0.0001 | 0.0001 | 0.0001 | 0.0005 | 0.0004 | | |
| B | 0.008 | 0.003 | 0.0025 | 0.07 | 0.005 | 0.0023 | | |
| Al | 98.203 | 97.878 | 98.027 | 97.759 | 97.474 | 97.516 | | |
| Sr | <0.0001 | 0.104 | <0.0001 | 0.154 | <0.0001 | <0.0001 | | |
| V | 0.0048 | 0.0055 | 0.0055 | 0.009 | 0.013 | 0.0084 | | |
| Zr | 0.0008 | <0.0003 | <0.0003 | <0.0003 | 0.00238 | 0.0026 | | |
| Others | 0.016 | 0.11 | 0.006 | 0.239 | 0.07 | 0.036 | | 0.15 |

TABLE VII

Summary of the $2^{nd}$ phase alpha-AlFeSi particle sizes (μm) following homogenizing solution heat treatments.

| | SN2 | | SN3 | | SN4 | |
|---|---|---|---|---|---|---|
| | 1,025° F. | 1,070° F. | 1,025° F. | 1,070° F. | 1,025° F. | 1,070° F. |
| 1 | 17.645 | 22.577 | 16.474 | 16.348 | 12.964 | 17.916 |
| 2 | 26.61 | 12.084 | 14.133 | 15.964 | 14.707 | 17.954 |
| 3 | 27.476 | 19.107 | 16.348 | 12.254 | 6.321 | 7.873 |
| 4 | 18.558 | 9.167 | 15.791 | 12.477 | 14.327 | 11.56 |
| 5 | 21.578 | 9.679 | 14.518 | 14.133 | 8.216 | 21.257 |
| 6 | 15.031 | 10.097 | 4.98 | 17.33 | 5.869 | 14.085 |
| 7 | 18.925 | 19.428 | 12.964 | 19.953 | 10.628 | 16.474 |
| 8 | 17.606 | 12..254 | 16.348 | 14.846 | 11.135 | 14.279 |
| 9 | 15.964 | 15.964 | 13.122 | 9.679 | 5.985 | 15.964 |
| 10 | 19.25 | 8.216 | 14.707 | 8.545 | 6.844 | 10.028 |
| 11 | 11.135 | 10.821 | 12.254 | 15.964 | 13.738 | 15.438 |
| 12 | 19.988 | 10.821 | 16.474 | 12.254 | 8.939 | 16.474 |
| 13 | 14.182 | 9.463 | 18.334 | 16.432 | 7.139 | 10.821 |
| 14 | 16.682 | 8.545 | 11.796 | 11.796 | 9.463 | 6.844 |
| 15 | 15.747 | 7.423 | 12.964 | 15.964 | 8.299 | 13.738 |
| Avg. | 18.4 | 12.4 | 14.1 | 14.3 | 9.6 | 14.0 |
| STDEV | 4.3 | 4.7 | 3.1 | 3.1 | 3.1 | 4.0 |

TABLE VIII

| Average distance (μm) between alpha-AlFeSi particles following heat treatments. | | |
|---|---|---|
| | 1025° F. | 1070° F. |
| SN2 | 248 μm | 239 μm |
| SN3 | 214 μm | 313 μm |
| SN4 | 110 μm | 116 μm |

Figure 11A:
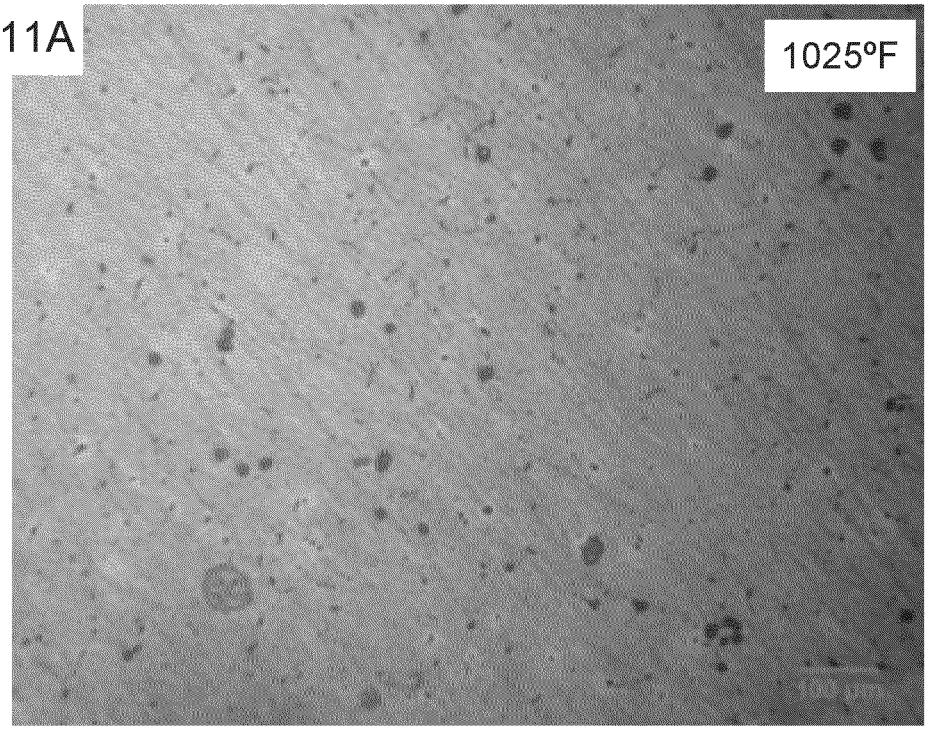
FIG. 11A-B are photomicrographs of a centrifugally formed low iron 6061 aluminum alloy including 0.1 wt % Sr that has been solution heat treated at 1,025° F. and 1,070° F., respectively.
Figure 11B:
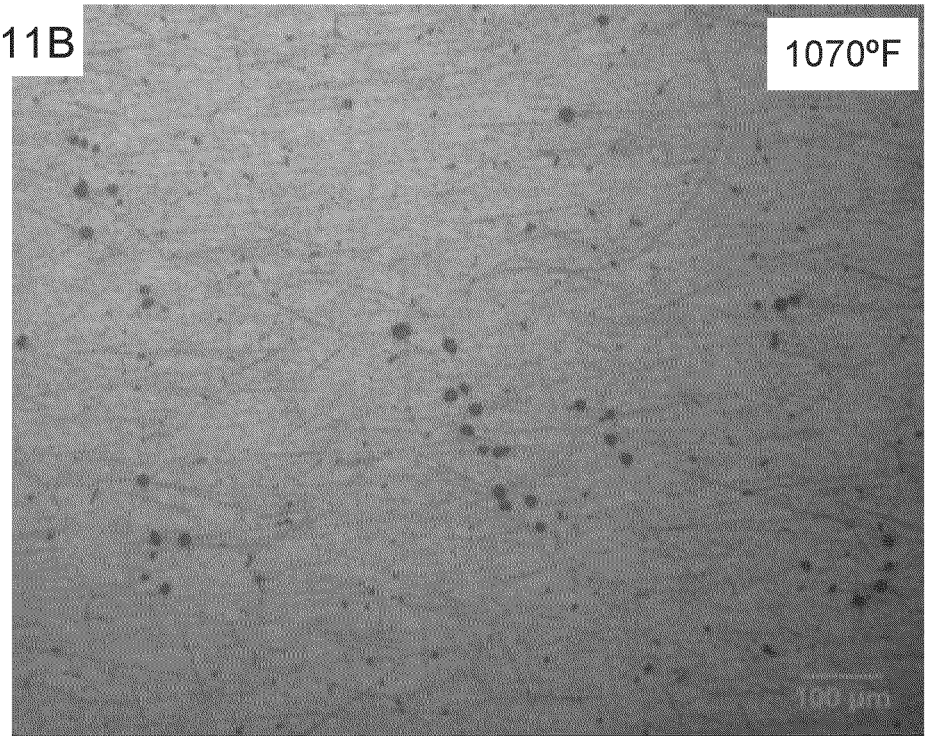
Figure 12A:
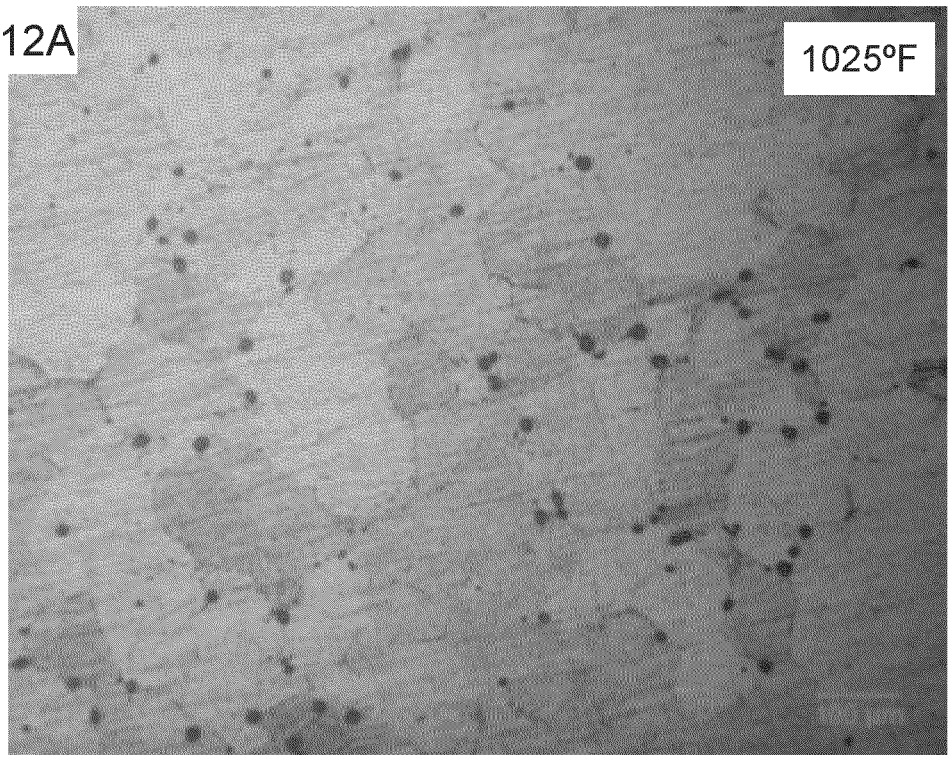
FIG. 12A-B are photomicrographs of a centrifugally formed low iron 6061 aluminum alloy without Sr that has been solution heat treated at 1,025° F. and 1,070° F., respectively.
Figure 12B:
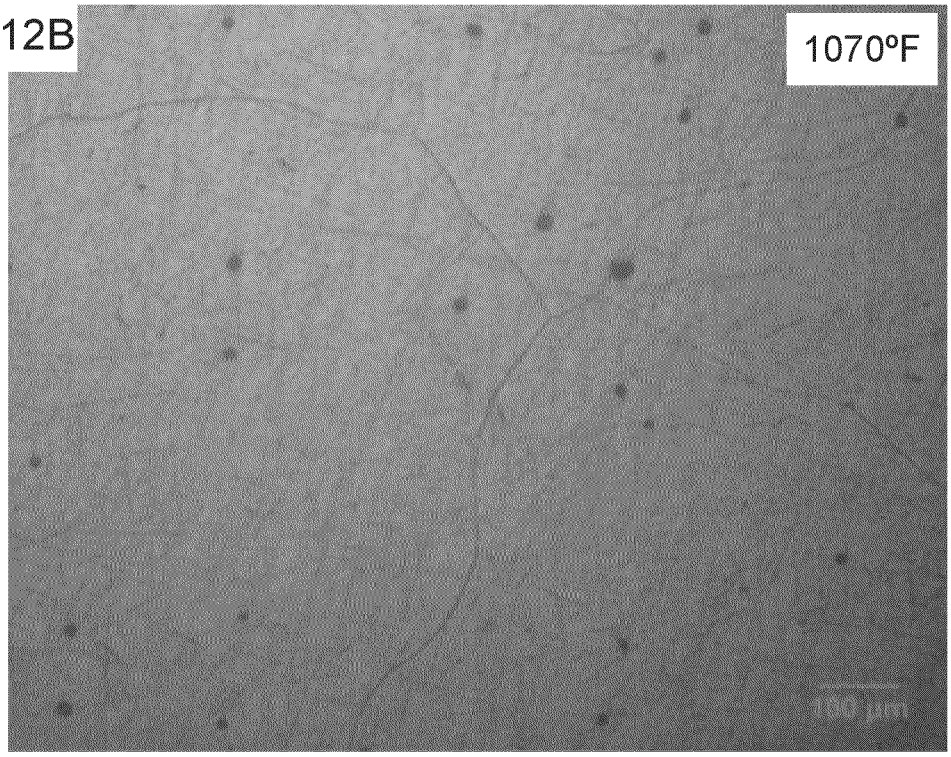
Figure 13A:
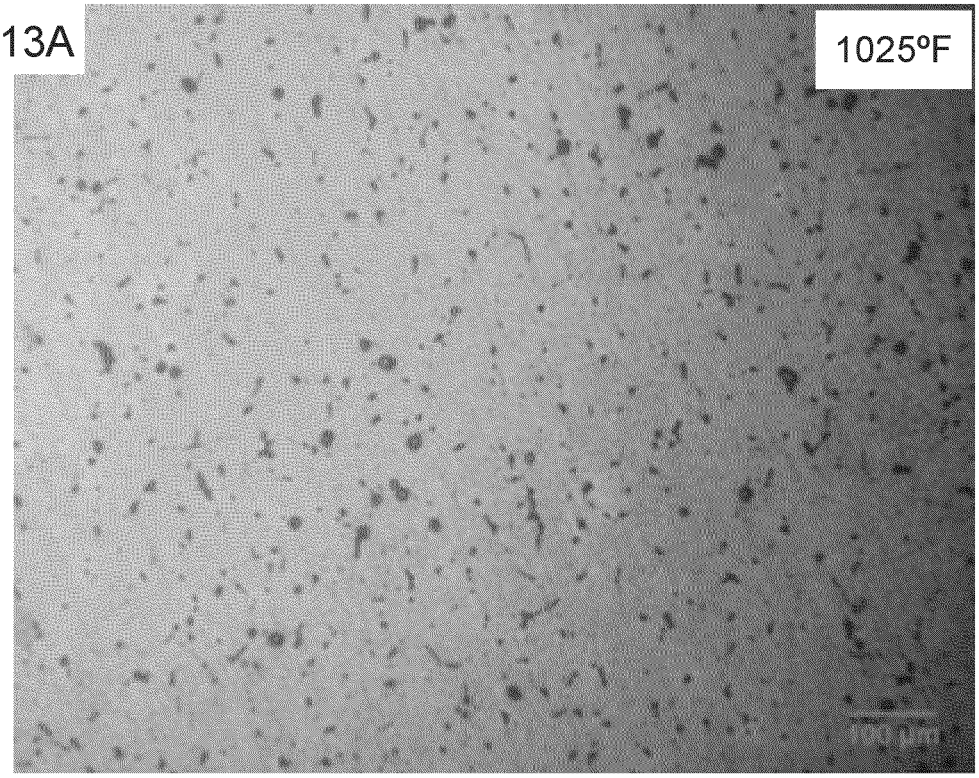
FIG. 13A-B are photomicrographs of a centrifugally formed low iron 6061 aluminum alloy including 0.15 wt % Sr that has been solution heat treated at 1,025° F. and 1,070° F., respectively.
Figure 13B:
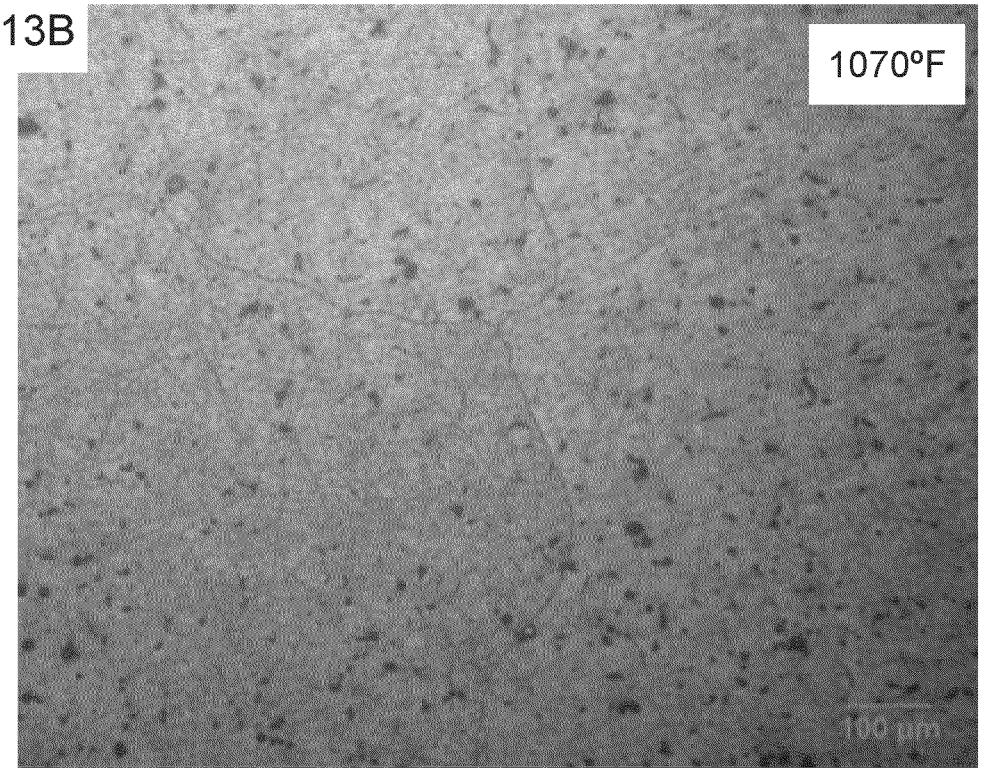

FIG. 11A-B are photomicrographs of SN2 samples (a centrifugally formed low iron 6061 (P0202) aluminum alloy including 0.1 wt % Sr) that have been solution heat treated at 1,025° F. and 1,070° F., respectively. FIG. 12A-B are photomicrographs of SN3 samples (P0202 aluminum alloy including no Sr) that have been solution heat treated at 1,025° F. and 1,070° F., respectively. FIG. 13A-B are photomicrographs of SN4 samples (P0202 aluminum alloy including 0.15 wt % Sr) that have been solution heat treated at 1,025° F. and 1,070° F., respectively.

As observed from the photomicrographs, the amount of script-like particles was significantly decreased by the use of P0202 aluminum ingot as a base. Homogenized particle size remained the same when using 1,070° F. versus 1,025° F. SN4 contained the highest amount of homogenized $2^{nd}$ phase particles (i.e., the alpha-AlFeSi particles), measured by average distance between particles. SN3 (no Sr) following 1,070° F. homogenization contained the fewest amount of homogenized $2^{nd}$ phase particles. Particle distribution, measured by the average distance between particles, remained unchanged with temperature for the Sr containing samples. Grain size significantly increased for all samples following the 1,070° F. homogenization.

Centrifugally or Semi-Centrifugally Formed Low Iron-Cr 6000 Series Aluminum Alloys The embodiments described in the Ser. No. 16/103,404 application included 6000 series aluminum alloys that included chromium having an average concentration of greater than 0.05 wt %. In contrast, embodiments described in the present disclosure include low iron-Cr 6000 series aluminum alloys, for example, 6000 series aluminum alloys having chromium in a range of 0.001 wt % to 0.05 wt % (e.g., 0.001, 0.002, 0.003, 0.004, 0.005, 0.006, 0.007, 0.008, 0.009, 0.01, 0.02, 0.03, 0.04 or 0.05 wt % inclusive of all ranges and values therebetween). In particular embodiments, the amount of chromium in such low iron-Cr aluminum alloy can be in the range of 0.001 wt % to less than 0.04 wt % (e.g., 0.001, 0.002, 0.003, 0.004, 0.005, 0.006, 0.007, 0.008, 0.009, 0.01, 0.02, 0.03 or 0.039 wt % inclusive of all ranges and values therebetween). In some embodiments, the amount of chromium in the low iron-Cr aluminum alloy is about 0.01 wt %. Such aluminum alloys (e.g., a 6000 series aluminum alloy) may be used to manufacture light weight simple or complex parts having enhanced anodized performance, where chromium contamination is of concern. Table IX lists the chemical compositions of a low iron-Cr 6000 series aluminum alloy and Table X lists the physical properties of such an alloy. Table XI lists the chemical composition of another low iron-Cr 6000 series aluminum alloy.

TABLE IX

| Composition of low iron-Cr 6000 series aluminum alloy. Specification | | | |
|---|---|---|---|
| Element | Minimum wt % | Maximum wt % | Typical wt % |
| Mg | 0.80 | 1.20 | |
| Si | 0.40 | 0.8 | |
| Cu | 0.15 | 0.25 | |

TABLE IX-continued

| Composition of low iron-Cr 6000 series aluminum alloy. Specification | | | |
|---|---|---|---|
| Element | Minimum wt % | Maximum wt % | Typical wt % |
| Cr | — | 0.05 | <0.01 |
| Fe | — | 0.05 | <0.01 |
| Zn | — | 0.05 | <0.01 |
| Mg | — | 0.05 | <0.01 |
| Ti | — | 0.1 | |
| Other, each | — | 0.02 | |
| Other, Total | — | 0.15 | |
| Aluminum | Remainder | | |

TABLE X

| Physical properties of low iron-Cr 6000 series aluminum alloy. | |
|---|---|
| Physical Constants | |
| Density (nominal) lb/cu. In at 68° F. | 0.098 |
| Specific Gravity | 2.700 |
| Melting Range, ° F. | 1080-1205 |
| Thermal Coefficient of Expansion (68-212° F.)/° F. | $13.1 \times 10^{-6}$ |
| Thermal Conductivity, BTU/ft · h. ° F. (at 68° F.) | 97 |
| Electrical Conductivity, % IACS (at 68° F.) | 38 |
| Electrical Resistivity, nOhm · m (at 68° F.) | 24 |
| Modulus of Elasticity, PSI × $10^6$ | 10 |
| Brinell Hardness 500 kg/10 mm ball | 95 |
| Average ASTM Grain Size (up to 3 inch wall) | #5 |

TABLE XI

| Composition of a 6000 series low iron-Cr aluminum alloy | | |
|---|---|---|
| Element | Minimum wt % | Maximum wt % |
| Magnesium | 0.80 | 1.20 |
| Silicon | 0.40 | 0.80 |
| Copper | 0.15 | 0.40 |
| Iron | — | 0.70 |
| Zinc | — | 0.25 |
| Manganese | — | 0.15 |
| Titanium | — | 0.15 |
| Chromium | — | 0.05 |
| Other, each | — | 0.05 |
| Other, total | — | 0.15 |
| Aluminum | — | Remainder |

The low iron-Cr aluminum alloys described herein can be formed using the method 100 or any other suitable method described herein. While method 100 generally includes the operation of forming a formed body (operation 104) via centrifugal casting in which the mold containing molten aluminum alloy is rotated at a speed of at least about 500 rpm, and a centrifugal acceleration of at least about 30 G, in other embodiments, the low iron-Cr aluminum alloy or any other aluminum alloy described herein may be formed using semi-centrifugal casting.

In centrifugal casting, the mold used for centrifugal casting is partially filled with the molten aluminum alloy. True centrifugal casting methods produce cylindrically shaped parts, but there are instances where shapes other than cylindrical are desired at the inner diameter or bore of the casting. In contrast, in semi-centrifugal casting, the mold is typically completely filled with the molten aluminum alloy through a central sprue formed in the mold. The rotational force is used to distribute the molten aluminum alloy to all regions of the mold. The material in the outer regions of the mold (i.e., further from a center of the axis of the mold), is subject to greater forces than the material in the inner regions of the mold. The greater the forces under which the molten metal solidified, the denser the material in that region. So, the density of a semi-centrifugally formed aluminum alloy increases radially outward from a center of the molded body. The high forces in the outer section that push the molten material against the mold wall also ensure a great surface finish of aluminum manufactured by semi-centrifugal casting.

Semi-centrifugal casting employing the use of cores behave more like traditional sand or permanent mold castings, where solidification is multi-directional and issues of center line shrinkage exist. In some embodiments, semi-centrifugal casting may include adding shape to the inner diameter or bore of a mold or core using variable rotational speeds (RPM) during the solidification process. Semi-centrifugal casting may allow use of lower speeds and G forces relative to centrifugal casting. Thus, semi-centrifugally forming may include rotating the mold containing molten aluminum alloy at a speed of less than 500 rpm (e.g., as low as 100 rpm), and a centrifugal acceleration of less than 30 G (e.g., less than 10 G). Such rotational speeds and G forces may allow formation of parabolic shapes at the inner diameter and formation of solid bottom castings.

Figure 14:
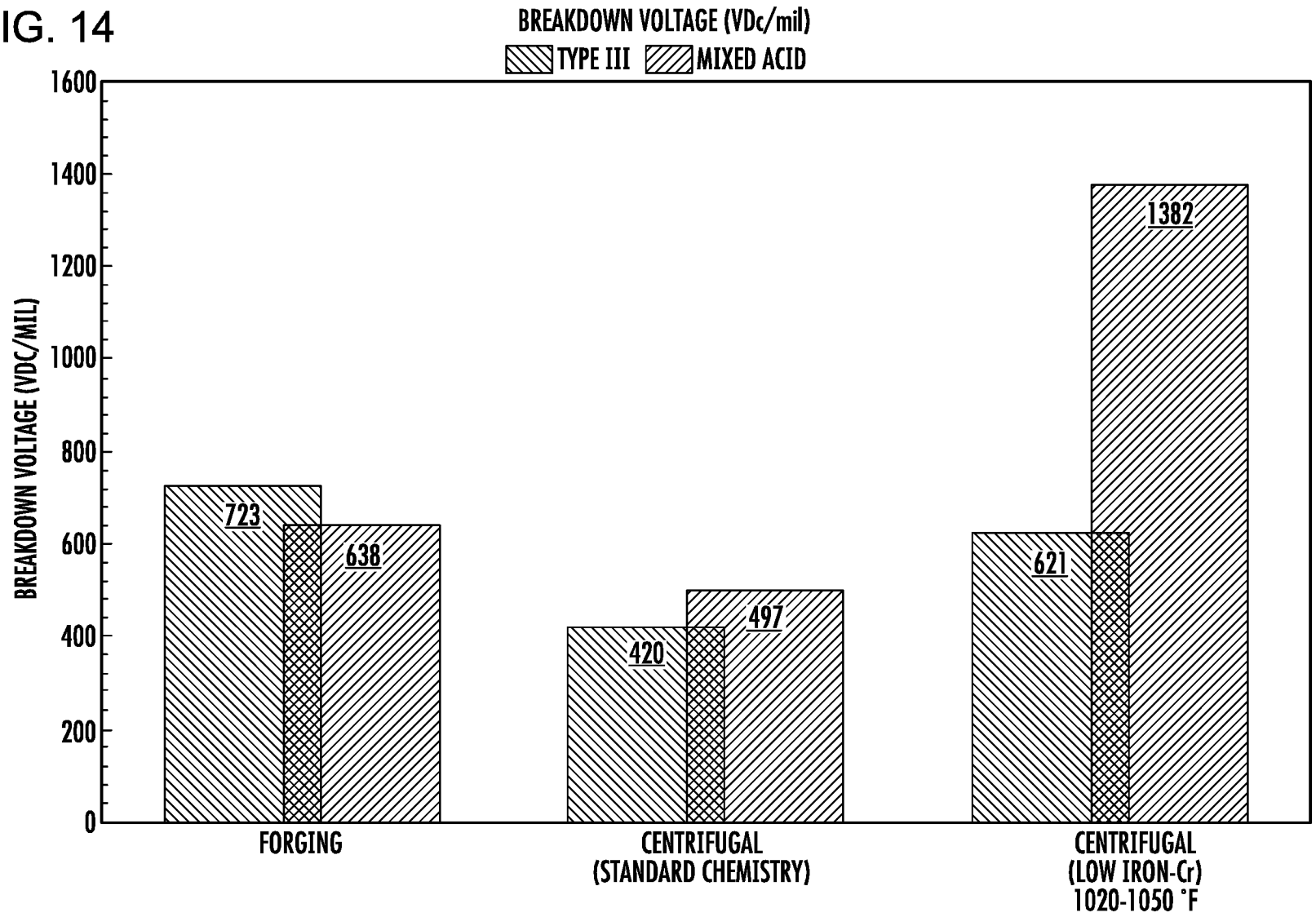
FIG. 14 show plots of dielectric strengths of the forged aluminum alloy, the centrifugally formed standard chemistry aluminum alloy 6061 and a centrifugally formed low iron-Cr 6000 series aluminum alloy that is also homogenized between 1,020° F. and 1,050° F. and anodized with sulfuric acid (Type III) or mixed acid.

Dielectric Strength (Breakdown Voltage):

FIG. 14 summarizes plots of dielectric strengths of a forged 6061-T6 aluminum alloy, a centrifugally formed standard chemistry aluminum alloy and a centrifugally formed low iron-Cr 6000 series aluminum alloy homogenized between 1,020° F. and 1,050° F. Each of the samples were anodized with sulfuric acid (Type III) bath or mixed acid bath. Breakdown voltage was similar for all samples anodized using the sulfuric acid, Type III method. Mixed acid anodization of the centrifugally formed low iron-Cr 6000 series aluminum alloy, however, produced breakdown voltages nearly double that of the forged 6061. The low Cr content of the low iron-Cr 6000 series aluminum alloy substantially reduces chromium contamination in parts in which chromium may not be desirable.

Figure 15:
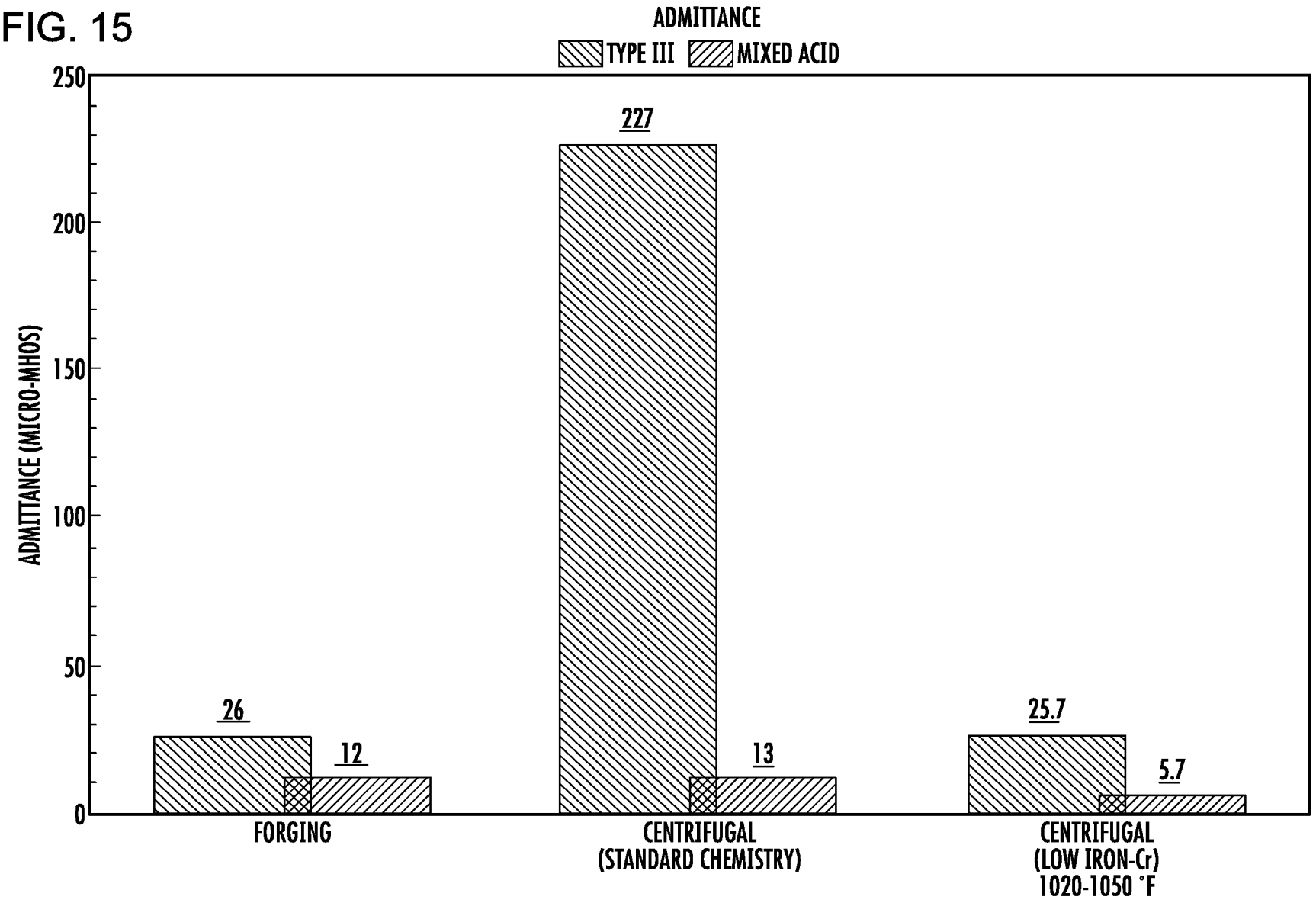
FIG. 15 show plots of admittance of the forged aluminum alloy, the centrifugally formed standard chemistry aluminum alloy 6061 and the centrifugally formed low iron-Cr 6000 series aluminum alloy of FIG. 14.

Admittance:

FIG. 15 summarizes plots of admittance of the forged 6061-T6 aluminum alloy, the centrifugally formed standard chemistry aluminum alloy and the centrifugally formed low iron-Cr 6000 series aluminum alloy homogenized between 1,020° F. and 1,050° F. The centrifugally formed low iron-Cr 6000 series aluminum alloy produced similar values to the forged 6061-T6 aluminum alloy when using the sulfuric acid Type III method. Using the mixed acid anodization, the centrifugally formed low iron-Cr 6000 series aluminum alloy produced the lowest numbers, approximately half those of the forged 6061-T6. Similar to the findings with the dielectric strength, homogenization of the centrifugally formed low iron-Cr 6000 series aluminum alloy at temperatures between 549° C. (1,020° F.) and 566° C. (1,050° F.) produced the lowest admittance.

Figure 16:
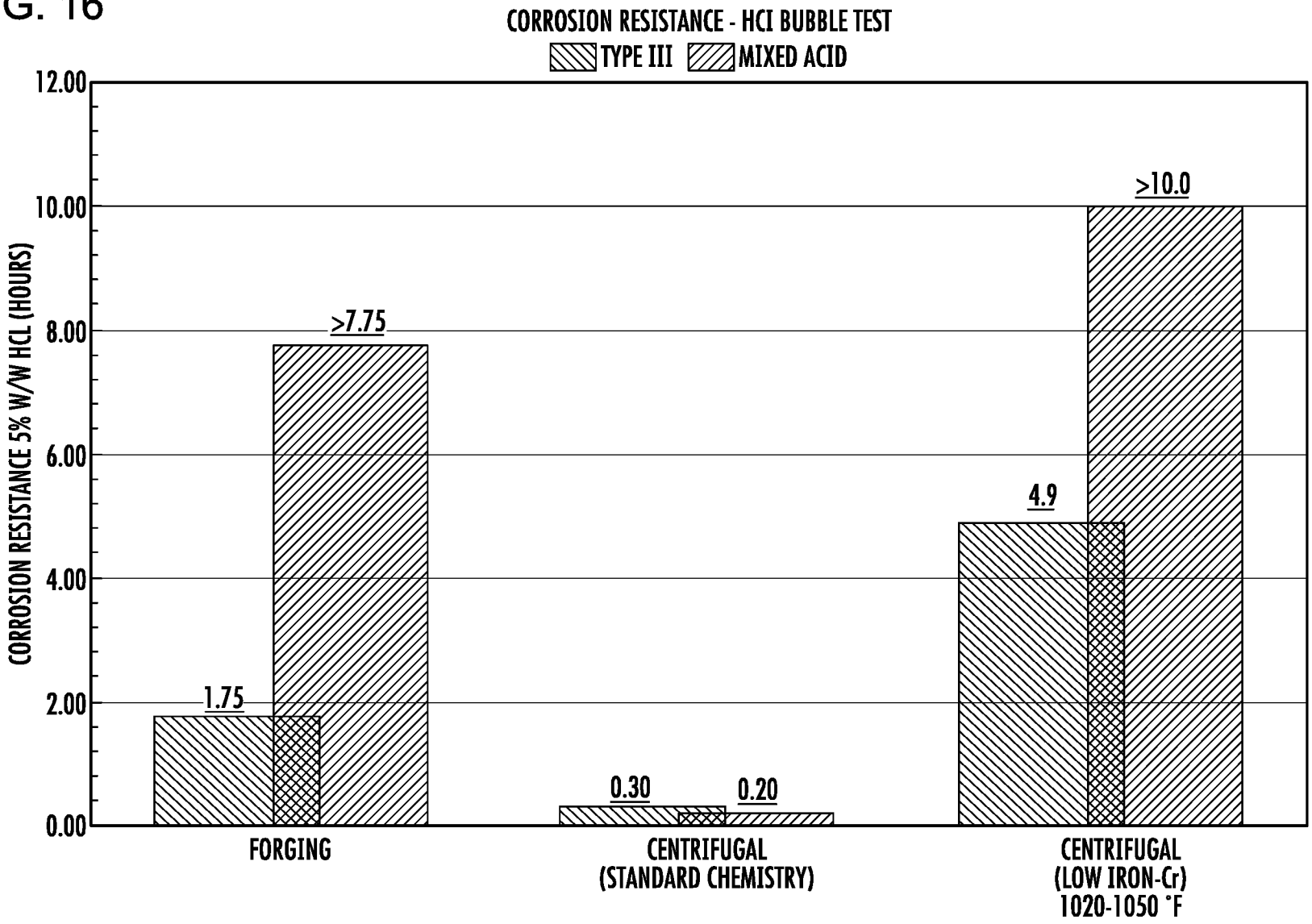
FIG. 16 show plots of corrosion resistance of the forged aluminum alloy, the centrifugally formed standard chemistry aluminum alloy 6061 and the centrifugally formed low iron-Cr 6000 series aluminum alloy of FIG. 14.

Corrosion Resistance:

FIG. 16 summarizes plots of corrosion resistance of the forged 6061-T6 aluminum alloy, the centrifugally formed standard chemistry aluminum alloy and the centrifugally formed low iron-Cr 6000 series aluminum alloy homogenized between 1,020° F. and 1,050° F. Corrosion resistance was measured by use of the HCl bubble test. Typical industrial standards are a minimum of 1 hour for forged 6061 and a minimum of 4 hours for 6061 plate material. For the sulfuric Type III anodization, the centrifugally formed low iron-Cr 6000 series aluminum alloy exhibited an improvement over the forged material specifically when homogenized between the temperatures of 1,020° F. and 1,050° F. Peak performance was also found in this temperature range for anodization using mixed acid, where failure was not observed after 10 hours of exposure.

Figure 17B:
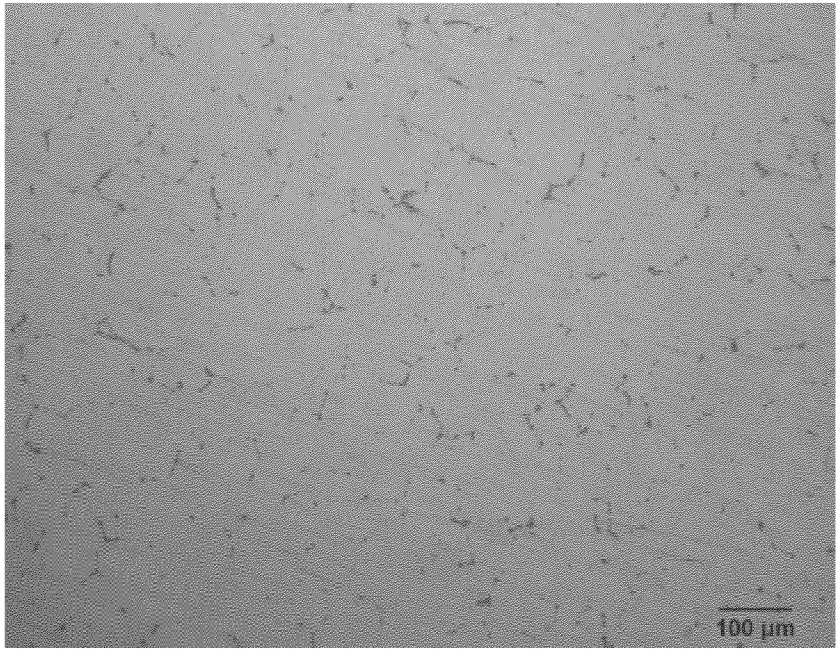
FIG. 17B is a photomicrograph of a centrifugally formed low iron-Cr 6000 series aluminum alloy following solution treatment at 985° F. and aging cycle.
Figure 17A:
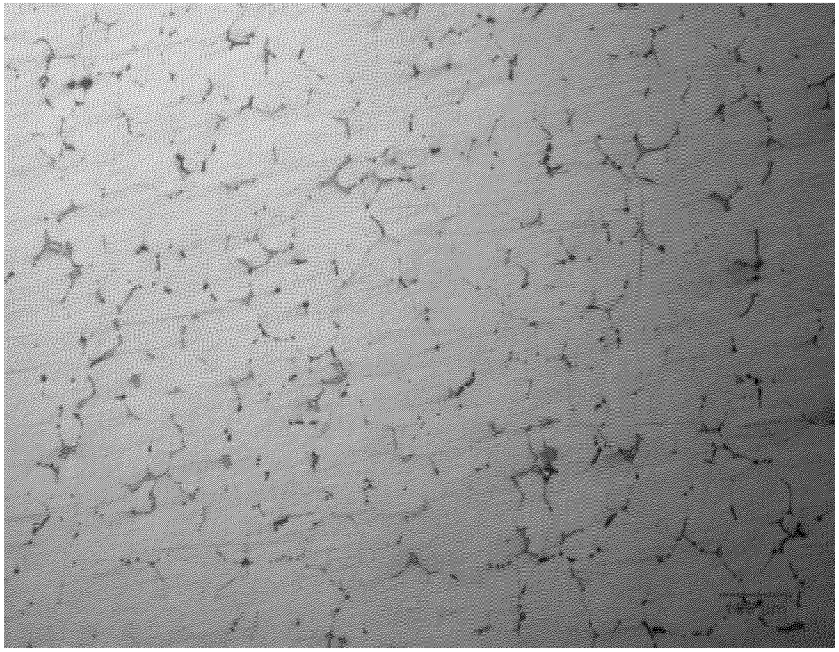
FIG. 17A is a photomicrograph of a centrifugally formed standard chemistry 6061 aluminum alloy.
Figure 18B:
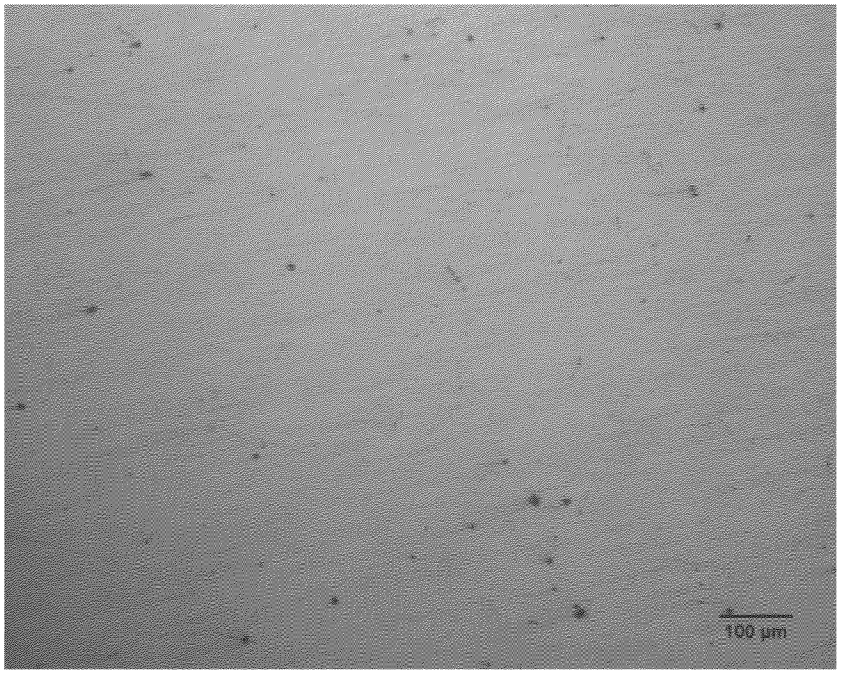
FIG. 18B is a photomicrograph of a centrifugally formed low iron-Cr 6000 series aluminum alloy following solution treatment at 1,050° F. and aging cycle.
Figure 18A:
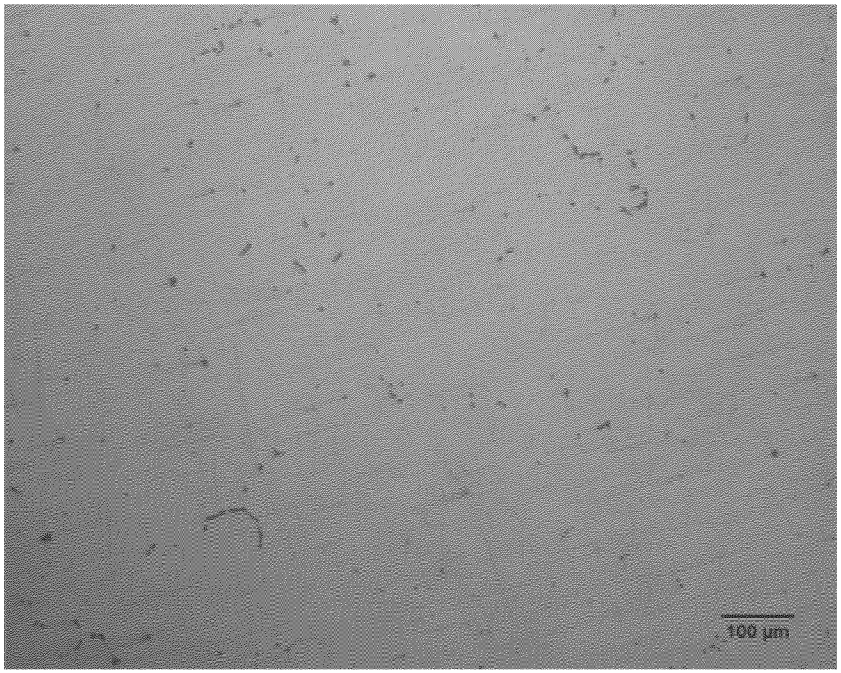
FIG. 18A is a photomicrograph of a centrifugally formed low iron-Cr 6000 series aluminum alloy following solution treatment at 1,020° F. and aging cycle.

FIG. 17A is a photomicrograph of a centrifugally formed standard chemistry 6061 aluminum alloy, and FIG. 17B is a photomicrograph of a centrifugally formed low iron-Cr 6000 series aluminum alloy following solution treatment at 985° F. and aging cycle. The samples are unetched and the photomicrographs are taken at 100× magnification. As observed from the photomicrographs, the amount of script-like beta-AlFeSi particles is significantly reduced in the centrifugally formed low iron-Cr 6000 series aluminum alloy relative to the aluminum alloy, though some of the beta-AlFeSi particles still remain. FIG. 18A is a photomicrograph of the centrifugally formed low iron-Cr 6000 series aluminum alloy following solution treatment at 1,020° F. and aging cycle, and FIG. 18B is a photomicrograph of a centrifugally formed low iron-Cr 6000 series aluminum alloy following solution treatment at 1,050° F. and aging cycle. Solution treatment at 1,020° F. resulted in most of the beta-AlFeSi particles being homogenized alpha-AlFeSi particles, while solution treatment at 1,050° F. homogenizes substantially all of the beta-AlFeSi particles into the alpha-AlFeSi particles.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the stated value. For example, about 0.5 would include 0.45 and 0.55, about 10 would include 9 to 11, about 1000 would include 900 to 1100.

As utilized herein, the terms "substantially' and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise arrangements and/or numerical ranges provided. Accordingly, these terms should be interpreted as indicating that insubstantial or inconsequential modifications or alterations of the subject matter described and claimed are considered to be within the scope of the embodiments as recited in the appended claims.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the embodiments described herein.

While this specification contains many specific implementation details, these should not be construed as limitations on the scope of any embodiment or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment.

What is claimed is:

1. A cast aluminum alloy article formed from a 6000 series aluminum alloy comprising chromium (Cr) in a range of 0.001 wt % to 0.05 wt %, and AlFeSi particles, wherein the cast aluminum alloy article is solution heat treated at a temperature in a range of 1,025-1,050° F. such that greater than 95% AlFeSi particles comprise alpha-AlFeSi particles and less than 5% AlFeSi particles comprise beta-AlFeSi particles, and further comprising a substantially continuous anodized layer of aluminum oxide covering an exterior surface of the cast aluminum alloy article, wherein the cast aluminum alloy article has a breakdown voltage of greater than 1,380 V/mil.

2. The cast aluminum alloy article of claim 1, wherein greater than 99% of the AlFeSi particles comprise alpha-AlFeSi particles such that the article is substantially free of beta-AlFeSi particles.

3. The cast aluminum alloy article of claim 1, comprising greater than 98 wt % Al.

4. The cast aluminum alloy article of claim 3, comprising less than 0.04 wt % Fe.

5. The cast aluminum alloy article of claim 4, comprising about 0.5-0.6 wt % Si, 0.16-0.19 wt % Cu, and 1.0-1.1 wt % Mg.

6. The cast aluminum alloy article of claim 3, comprising 0.1-0.15 wt % Sr.

7. The cast aluminum alloy article of claim 1, wherein the aluminum alloy comprises a 6061 aluminum alloy.

8. The cast aluminum alloy article of claim 1, having a percent elongation in a range of 5-15%, a yield strength in a range of 42-44 KSI and an ultimate tensile strength in a range of 44-46 KSI.

9. The cast aluminum alloy article of claim 1, wherein the cast aluminum alloy article has an admittance of less than 6 μMhos.

10. The cast aluminum alloy article of claim 1, wherein the cast aluminum alloy article has a corrosion resistance of equal to or greater than 10 hours in 5 wt % HCl.

* * * * *